US005489933A

United States Patent [19]

Betsui et al.

[11] Patent Number: 5,489,933

[45] Date of Patent: Feb. 6, 1996

[54] FIELD EMISSION MICROCATHODE ARRAY AND PRINTER INCLUDING THE ARRAY

[75] Inventors: Keiichi Betsui; Hiroshi Inoue; Shin'ya Fukuta, all of Kawasaki, Japan

[73] Assignee: Fujitsu Limited, Kawasaki, Japan

[21] Appl. No.: 829,882

[22] Filed: Feb. 3, 1992

[30] Foreign Application Priority Data

Feb. 1, 1991 [JP] Japan ..... 3-011786
Apr. 17, 1991 [JP] Japan ..... 3-084852

[51] Int. Cl.[6] ..... B41J 2/435; G09G 3/10

[52] U.S. Cl. ..... 347/120; 347/122; 347/129; 347/141; 315/169.1; 315/169.3

[58] Field of Search ..... 346/107 R, 158; 315/169.3, 169.4, 169.1; 347/122, 121, 120, 129, 233, 141, 238

[56] References Cited

U.S. PATENT DOCUMENTS 4,835,438 5/1989 Baptist et al. .
4,908,539 3/1990 Meyer ..... 315/169.3
5,166,709 11/1992 Kubelik ..... 346/158

FOREIGN PATENT DOCUMENTS 0454566 10/1991 European Pat. Off. .
2644287 9/1990 France .

OTHER PUBLICATIONS

*Patent Abstracts of Japan,* Unexamined Applications, E–field, vol. 12, No. 268, Jun. 27, 1988, The Patent Office Japanese Government, p. 77 E 638.

*Primary Examiner*—Benjamin R. Fuller
*Assistant Examiner*—David Yockey
*Attorney, Agent, or Firm*—Staas & Halsey

[57] ABSTRACT

In a field emission microcathode array, a plurality of cones are arranged in a plurality of blocks, each of plural cones, on the main surface of a substrate, each cone having a sharp tip. A plurality of gate electrode portions respectively correspond to the blocks, each portion having a plurality of openings therein corresponding to the plurality of cones of the respective block, each opening being aligned with and disposed in surrounding relationship relative to the corresponding tip of the respectively associated cone. A plurality of lead electrodes, each configured as a fuse, are respectively connected to the plurality of gate electrode portions and each lead electrode provides an independent connection of the respective gate electrode portion to the common power source. In another embodiment, each gate electrode portion and wiring films connected thereto have respectively high and low resistances. In a further embodiment, each gate electrode portion includes openings of different sizes surrounding tips of the cones.

18 Claims, 19 Drawing Sheets

FIELD EMISSION MICROCATHODE ARRAY AND PRINTER INCLUDING THE ARRAY

BACKGROUND OF THE INVENTION

1. Field of the Invention

The present invention relates to a field emission microcathode array, and particularly to an improvement of a field emission microcathode array involving emitter cones for emitting electrons. The emitter cones are grouped into small blocks so that, even if an electrode-to-electrode short circuit occurs in any one of the small blocks, the failure will be confined to the small block in question, thereby improving the reliability of the array as a whole. The present invention also relates to a field emission microcathode array involving a gate electrode having openings of different sizes to expand the operation margin.

2. Description of the Related Art

Field emission microcathodes are essential for vacuum microdevices such as very small microwave vacuum tubes and display elements.

FIGS. 1(A) and 1(B) illustrate a structure of a field emission microcathode, where FIG. 1(A) is a perspective view and FIG. 1(B) is a sectional view.

In the figures, a substrate 1' is made of, for example, a semiconductor. A cone 2' serving as an emitter is formed on the substrate 1'. A tip 20' of the cone 2' is surrounded by a gate electrode 30. The substrate 1' is separated from the gate electrode 30 by a gate insulation film (not shown). A gate opening 3 is formed around the tip 20' of the cone 2'. Operational characteristics of this field emission microcathode are mainly determined by the radius Rg of the gate opening 3, the height Ht of the cone 2', and the thickness Hg of the gate insulation film.

The semiconductor substrate 1' serves as a cathode electrode. This substrate may be made of insulation material and a cathode electrode made of a conductive film may be disposed between the substrate and the cone. Usually, these elements are made several micrometers or smaller in size by photolithography which is known in the field of semiconductor ICs.

When a negative voltage is applied to the cone 2' and the gate electrode 30 is positive, the tip 20' of the cone 2' emits electrons. Namely, the cone 2' acts as a field emission microcathode.

Although the example of FIGS. 1(A) and 1(B) involves only one emitter cone, a plurality of cones may be arranged in an array on a single substrate, and FIGS. 2(A) and 2(B) are examples of such a field emission microcathode array forming a display; more specifically, FIG. 2(A) is a sectional view showing an essential part of the display and FIG. 2(B) is a schematic view explaining a method of driving the display.

In FIGS. 2(A) and 2(B), the field emission microcathode array 50' comprises many field emission microcathodes formed on a substrate 1'. The microcathodes may be arranged two-dimensionally, or in longitudinal and lateral rows, to form an X–Y matrix on the substrate 1'.

The field emission microcathode array itself is already known. It may be made in sizes and pitches disclosed by the present inventors (Institute of Electronics, Information and Communication Engineers of Japan, Autumn National Convention, 1990, SC-8-2, 5-28-2).

Opposite the field emission microcathode array 50', there is arranged a transparent substrate 10 made of, for example, glass. Anodes 12 are formed on the lower face of the substrate 10. Each of the anodes 12 is made of an ITO ($In_2O_3$-$SnO_2$) film having a thickness of 200 to 300 nm and an area of 100×100 μm. A pitch between the adjacent anodes 12 is about 30 μm. On each of the anodes 12, a fluorescent dot 11 smaller than the anode 12 is disposed. The dot 11 is made of, for example, a ZnO:Zn film having a thickness of 2 μm. Each dot 11 forms a pixel.

The substrates 1' and 10 are spaced apart from each other by a distance of about 200 μm, to form a display panel 100.

The display panel 100 is driven by a control circuit (an anode selection circuit) 200 shown in FIG. 2(B). The anode selection circuit 200 is connected to the anodes 12. A gate power source 260 applies a gate voltage so that the cones 2' simultaneously emit electrons, which are specifically attracted by a specific one of the anodes 12 that are selected by the anode selection circuit 200. The electrons attracted by the specific anode cause the fluorescent dot 11 on the anode 12 in question to emit light.

In this way, the anode selection circuit 200 properly selects an anode 12, to which a positive potential is applied thereby to cause the fluorescent dot 11 on the selected anode 12 to emit light, thus driving the display.

FIGS. 3(A) to 3(C) show a conventional arrangement of a field emission microcathode array, where FIG. 3(A) is a perspective view, FIG. 3(B) a partially enlarged view, and FIG. 3(C) a sectional view along a line 3(C)—3(C) of FIG. 3(A).

In the figures, a substrate 1 is made of glass. A cathode 6 is formed on the substrate 1, and an insulation film 7 is formed on the cathode 6. Many cones 2 are two-dimensionally arranged on and formed in the insulation film 7. A gate electrode 30 having gate openings 3 is laminated such that each opening 3 surrounds a tip 20 of a corresponding cone 2, to thereby form a field emission microcathode array 50'.

In this example, the cones 2 are two-dimensionally arranged over the substrate 1. They may be arranged in longitudinal and lateral rows to form an X–Y matrix for each pixel (IEEE Trans. on Electron Device, Vol. 36, p. 225, 1989).

The microcathodes, each having a diameter of several micrometers, of the array 50' may be arranged at intervals of several micrometers, so that several hundreds of microcathodes can be arranged for each pixel to form an area of about 100×100 μm. This produces a bright screen and provides good redundancy against unevenness in brightness caused by differences in the characteristics of individual microcathodes.

If the tip 20 of the cone 2 is short-circuited to the electrode 30 due to conductive dust or broken chips of the cone, a critical problem may arise, in that the emission of electrons may thereby stop, for a corresponding pixel or even over a display screen as a whole. This problem must be solved.

FIG. 4 shows models of problems that occur on the field emission microcathode array.

If the tip of a cone formed between the cathode 6 and the gate electrode 30 is broken, as illustrated in the case of a cone 2', no electron will be emitted to drive the emitter in question.

If the shape of a cone is deformed, as in the case of a cone 2", the cone will be short-circuited to the gate electrode 30 and thereby will equalize the potential of the gate and emitter. This causes all emitters to malfunction and causes an excessive current to flow through the gate electrode 30, thereby breaking the array as a whole.

To solve these problems, accordingly, an object of the present invention is to provide a field emission microcathode array that ensures continuous operation of the array as a whole even if a cone is locally short-circuited to a gate electrode.

The center of each opening 3 of the gate electrode 30 must correctly agree with the center of the tip of a corresponding cone 2 according to a conventional fabrication method. What is important is the distance between the gate electrode and the tip of the cone. If the distance satisfies certain criteria, a sufficient emission current will be obtained. If the distance is not within the criteria, the emission current will be impractically low. Namely, the diameter of each gate opening or the distance between the tip of the cone and the gate electrode must be strictly controlled.

FIG. 5 explains this issue. When the diameter of the opening 3 of the gate electrode 30 is properly set, the emission current is remarkably high. If the optimum condition is not met even slightly, the emission current becomes drastically low.

FIG. 6 shows a relationship between a gate voltage Vg and an emission current Ie with a change in the diameter of the gate opening being a parameter. In the figure, the ordinate represents the discharge (i.e., emission) current Ie, and the abscissa the gate voltage Vg. Curves (1) to (3) represent the characteristics of field emission cathodes having respective, different gate opening sizes as shown in FIG. 12, discussed in more detail hereinafter, curve (1) represents the characteristics of a field emission cathode with a middle-sized gate opening 3*b*, curve (2) represents the characteristics of a field emission cathode with a small-sized gate opening 3*c*, and curve (3) represents the characteristics of a field emission cathode with a large-sized gate opening 3*a*.

An optimum radius of the gate opening is Rgo. If the actual size (i.e., radius) of any gate opening is larger or smaller than the optimum, it produces a very small emission current. Namely, a sufficient emission current will not be obtained if the radius of the gate opening differs from the optimum value.

Accordingly, the area and shape of each opening of the gate electrode in the field emission microcathode array must be strictly fabricated through precise designing and process control. Even under such strict control, the diameters of openings of the gate electrode may fluctuate for some reason. In this case, the production costs of the microcathode array may increase since the production yield may decrease.

Another object of the present invention is to provide a field emission microcathode array that is free from the above problems associated with conventional techniques, sufficiently demonstrates specified characteristics, and can be efficiently fabricated with a high production yield at a low cost.

SUMMARY OF THE INVENTION

To achieve the above objects, a first aspect of the present invention provides a field emission microcathode array comprising a substrate over which a plurality of cones, each cone having a sharp tip is formed, and a gate electrode having a plurality of openings, each opening surrounding the tip of a corresponding cone. The tip of each cone emits electron beams due to field emission. The cones are grouped into small blocks. Each of the blocks involves several of the cones and provided with its own gate electrode portion. The respective gate electrode portions of the small blocks are independent of one another. Each of the gate electrode portions is connected to a power source through a lead electrode.

A second aspect of the present invention provides a field emission microcathode array comprising a substrate over which a plurality of cones, each cone having a sharp tip, is formed, and a gate electrode having a plurality of openings, each opening surrounding the tip of a corresponding cone. The tip of each cone emits electron beams because field emission. The openings of the gate electrode have respective, different sizes and are intermingled.

According to the first aspect of the invention, field emission microcathodes for each pixel area are grouped into small blocks 4 (FIG. 7). Each of the small blocks 4 has a lead electrode 31 for conducting electricity to a gate electrode 30. The lead electrode 31 serves as a fuse. If one of the cones 2 in any one of the small blocks 4 is short-circuited to the gate electrode 30, the failure to stop electron emission will be limited in the small block 4 in question. In this way, dividing each pixel area into small blocks 4 increases redundancy and improves the reliability of, for example, a display unit employing the field emission microcathode array of the invention.

According to the second aspect of the invention, the gate electrode openings 3 (5) that greatly influence electron beam emission characteristics are prepared in, for example, three sizes (large, middle, and small) and are intermingled the sizes are characterized by the radius (Rg) of the generally circular openings 3 (FIGS. 1(A) through 12 and see especially FIG. 1 (B)) and by the lateral spacing between opposite edges of elongated, grove-like gate electrode openings 5 as shown in FIGS 13–15 and which openings are of a width 2Rg, symmetrically formed relatively to an elongated blade 40 of an elongated emitter 4 (see especially FIGS. 14 and 15). Even if the actual sizes of some openings deviate slightly from a designed value due to manufacturing errors, at least certain of the openings 3 and 5, relative respectively to the cones 2 or blades 40 will have the optimum radii and widths, respectively, so as to self-selectively emit electron beams. This arrangement ensures stable electron emission for a large area or along a long line on, for example, a display unit.

When the openings having different sizes are intermingled, the large-sized gate openings will have an optimum radius if each opening is made with a reduced radius due to fabrication errors. On the other hand, if each opening is made with an increased radius due to fabrication errors, the small-sized gate openings will have an optimum radius.

DESCRIPTION OF THE PREFERRED EMBODIMENTS

Preferred embodiments of the present invention will be explained in detail with reference to the drawings.

Figure 7A:
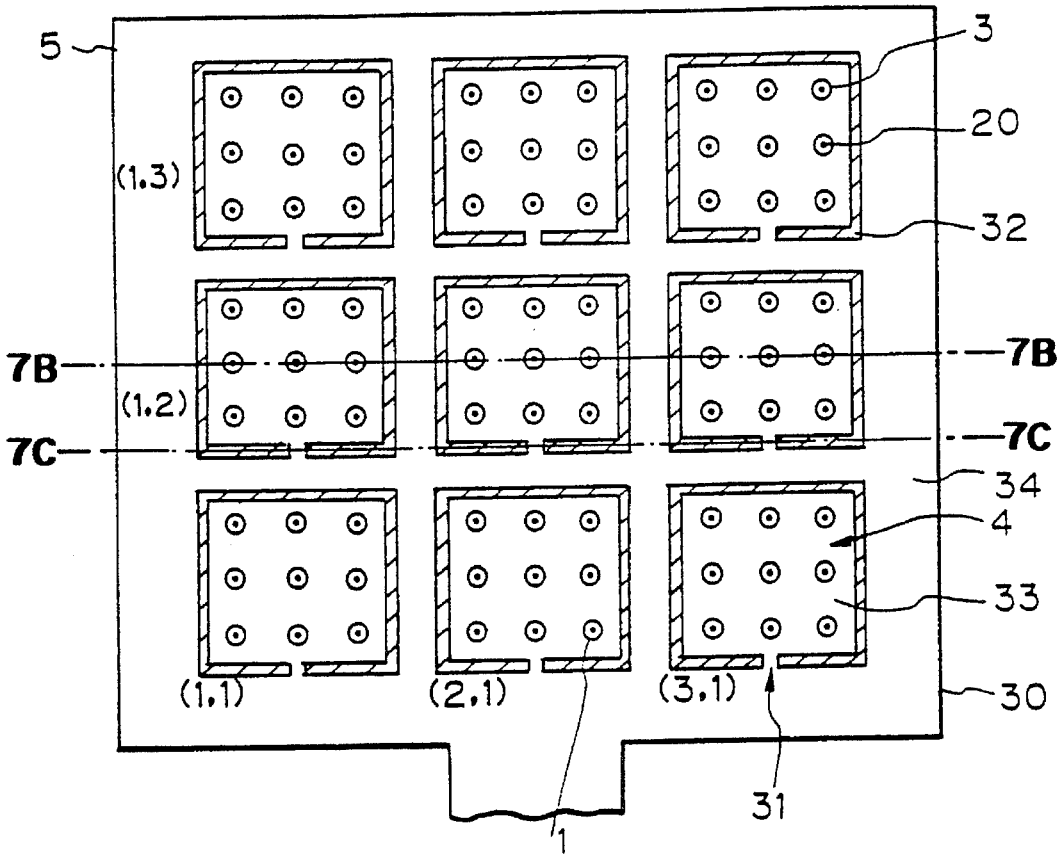
FIGS. 7(A) to 7(C) are views showing an embodiment according to the first aspect of the invention.
Figure 7B:
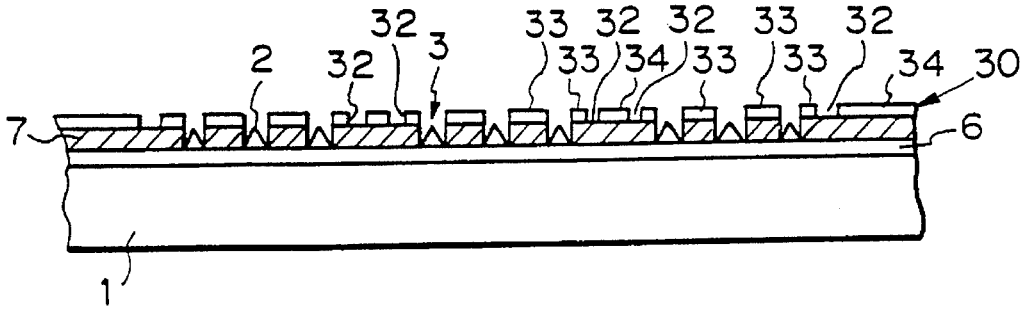
Figure 7C:
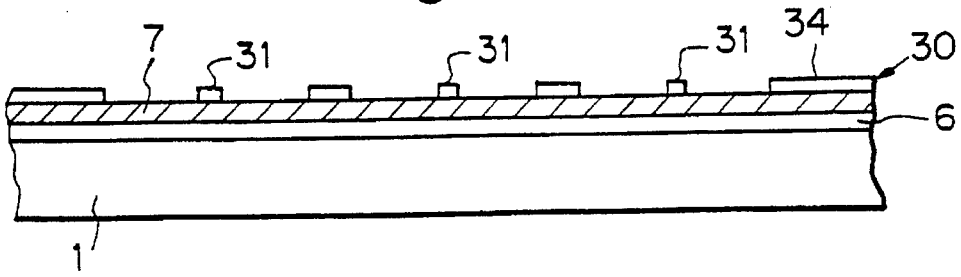

FIGS. 7(A) to 7(C) show an embodiment according to the first aspect of the invention, in which FIG. 7(A) is a plan view showing one pixel area 5, FIG. 7(B) a sectional view along a line 7B—7B of FIG. 7(A), and FIG. 7(C) a sectional view along a line 7C—7C of FIG. 7(A).

In the figures, numeral 4 denotes a small block including a plurality of field emission microcathodes, 5 a pixel area, and 31 a lead electrode for connecting, in each small block 4, an inner portion (a subelectrode portion) 33 to an outer portion (a main electrode portion) 34 of a gate electrode 30. Namely, the lead electrode 31 connects the subelectrode portion 33 of a corresponding small block 4 to the main electrode portion 34 outside the small block 4.

The same reference numerals as those shown in previous drawings represent like parts, and therefore, their explanations will not be repeated.

In FIGS. 7(A) to 7(C), substrate 1 is a glass plate of, for example, 1.1 mm thick. A cathode 6 made of, for example, a Ta film having a thickness of 100 nm is formed by sputtering. An insulation film 7 made of, for example, an $SiO_2$ film of 1000 nm thickness is disposed over the cathode 6. On the cathode 6, there is formed the gate electrode 30 with a film of Cr, Ta, or Mo having a thickness of about 150 nm by a known method.

Openings 3 are formed on the gate electrode film 30, and aligned holes for cones are formed on the insulation film 7. Thereafter, Mo, for example, is obliquely deposited on the surface portions of the cathode 6 exposed at the bottoms of the holes, thereby forming cones 2 (J. Appl. Phys., Vol. 39, p. 3504, 1968).

In FIG. 7(A), the pixel area 5 extends for 100×100 μm and encompasses 9×9=81 cones 2, i.e., field emission microcathodes, arranged in a matrix. The 81 cones are grouped into nine small blocks 4 each involving 3×3=9 cones. Each of the small blocks 4 is surrounded by a groove 32 formed on the gate electrode 30. The width of the groove 32 may be about 5 μm. At part of the groove 32, the lead electrode 31 having a width of 2 to 3 μm is formed to electrically connect the subelectrode and main electrode portions 33 and 34 to each other, the electrode portions 33 and 34 being located inside and outside the small block 4, respectively.

If one small block 4 whose coordinates (X, Y) are (2, 1) causes a short circuit between one field emission microcathode (1) and the subelectrode portion 33, a current flowing through the subelectrode portion 33 collects at the lead electrode 31, which will be heated to a high temperature and fused off (i.e., broken, or opened). As a result, the short-circuit failure is confined in the small block 4 (2, 1), and each of the remaining eight small blocks 4 continues to function normally as a display portion of the pixel area 5, thereby greatly improving the reliability of the display unit as a whole.

According to the embodiment, the gate electrode 30 may be formed of a Cr film having a thickness of 150 nm, and the lead electrode 31 may be formed by photoetching the Cr film to a width of 2 μm. In this case, when the field emission microcathode array is subjected to a gate voltage of 80 V and a normal gate current of 1 μA and if any one of the cones 2 is short-circuited in any one small block 4 which is thus defective, a large current of about 10 mA flows, thereby to fuse the lead electrode 31 of the defective small block 4 in question, in a very short time.

Figure 8A:
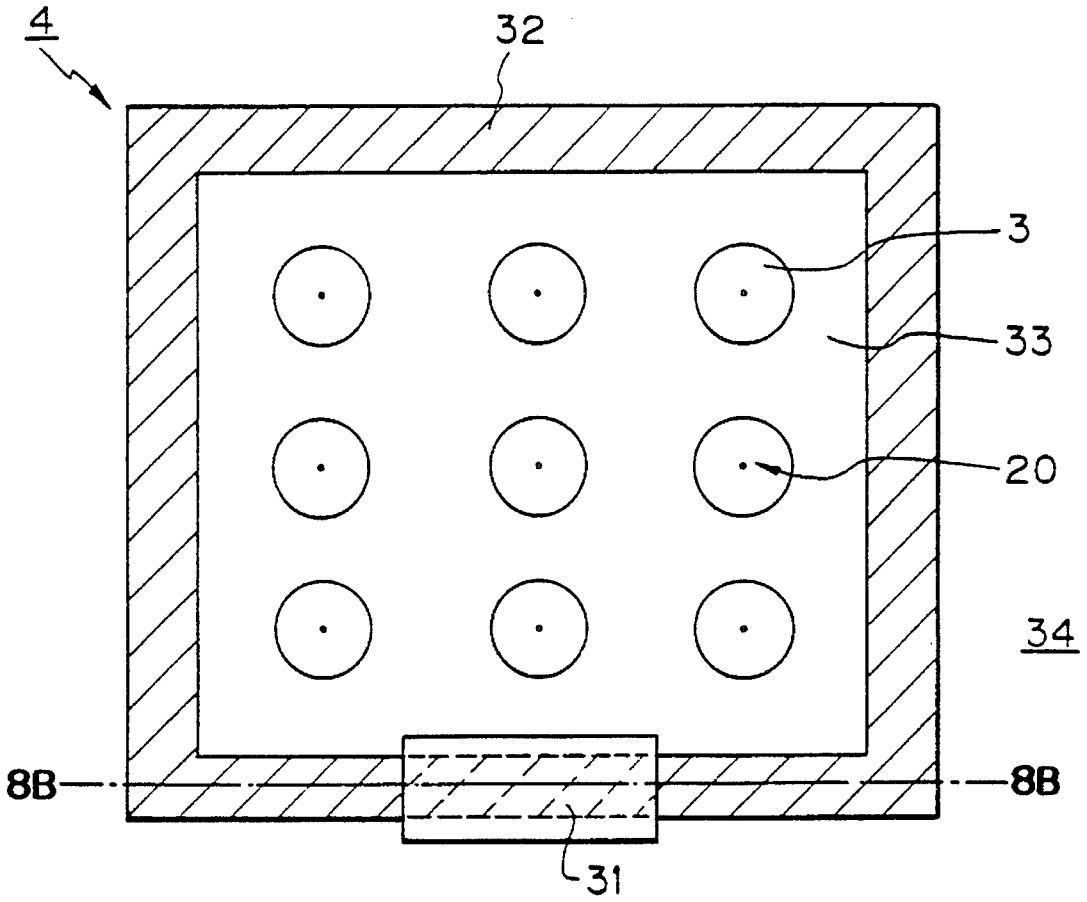
FIGS. 8(A) and 8(B) are views showing another embodiment according to the first aspect of the invention.
Figure 8B:
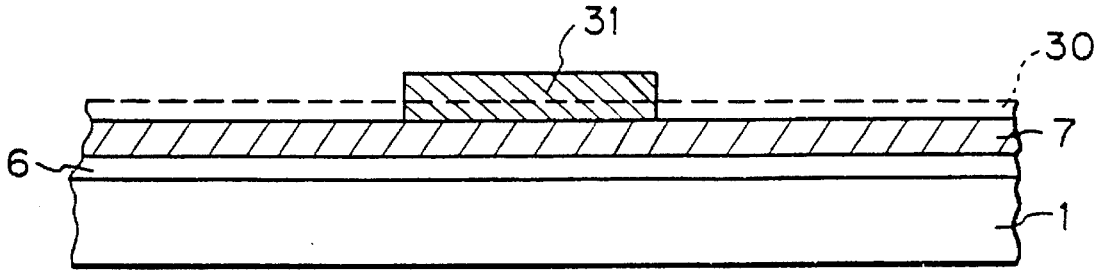

FIGS. 8(A) and 8(B) shows another embodiment according to the first aspect of the invention, in which FIG. 8(A) is a plan view showing one small block 4, and FIG. 8(B) a sectional view along a line 8B—8B of FIG. 8(A).

According to the embodiment of FIGS. 7(A) to 7(C), the lead electrode 31 is made of the same metal film as that of the gate electrode 30 including the subelectrode portions 33 and main electrode portion 34. According to the embodiment of FIGS. 8(A) and 8(B), the small block 4 is completely surrounded and isolated by a groove 32 formed on a gate electrode 30. At part of the groove 32, a separate lead electrode 31 having a width of 5 to 10 μm is formed to connect the inside and outside portions of the gate electrode film 30 of the small block 4 to each other.

Since the gate electrode 30' is made of high-melting metal such as Cr, Ta, and Mo, the width of the lead electrode 31' must be narrow, for example 2 μm.

To achieve this, this embodiment completely surrounds the small block 4 with the groove 32 formed on the gate electrode 30, and forms the relatively wide lead electrode 31' at part of the groove 32, with a low-melting conductor such as solder. In this case, the width of the lead electrode 31' may be expanded to 5 to 10 μm, and if required, the lead electrode 31' may be designed to fuse at an optional (i.e., desired) current value.

As explained above, each small block 4 of the field emission microcathode array has the lead electrode 31' for supplying a current to the gate electrode film 30. The lead electrode 31' serves as a fuse, and even if any one of the cones 2 in the small block 4 is short-circuited to the subelectrode portion 33, the failure of electron emission is confined in the small block 4 in question. In this way, dividing each pixel area into many small blocks 4 can greatly improve the redundancy and reliability of, for example, a display unit employing the field emission microcathode array of the invention.

According to the first aspect of the invention, the independent subelectrode portion 33 is formed in each small block 4 of the cones 2. More precisely, the gate electrode 30 comprises the main electrode portion 34 connected to a proper power source and the subelectrode portions 33 disposed in the main electrode portion 34 and each having openings surrounding the tips of the cones, respectively. Each of the subelectrode portions 33 is isolated from the main electrode portion 34 by the groove 32. At part of the groove 32, however, the main electrode portion 34 and the subelectrode portion 33 are electrically connected to each other through the lead electrode 31 (31') made of electrically conductive material.

According to the first aspect of the invention, instead of arranging the subelectrode portion 33 for each of the small blocks 4, a gate electrode film 41 (FIG. 9) made of high resistance material may be formed for each of the small blocks 4.

More precisely, the gate electrode disposed around the cones 2 is made of high resistance material, and wiring 42 made of low resistance material is arranged around the gate electrode 41.

If any one cone 2 is short-circuited to the gate electrode 41, the small block containing the short-circuited electrode 41 may stop operating because the cone 2 and gate electrode 41 are set to an equal potential. The other small blocks, however, operate normally because the gate electrodes 41 of the other small blocks are connected to the wiring 42 made of low resistance material. This arrangement, therefore, improves the redundancy and reliability of, for example, a display unit employing the field emission microcathode array of the invention.

Figure 9A:
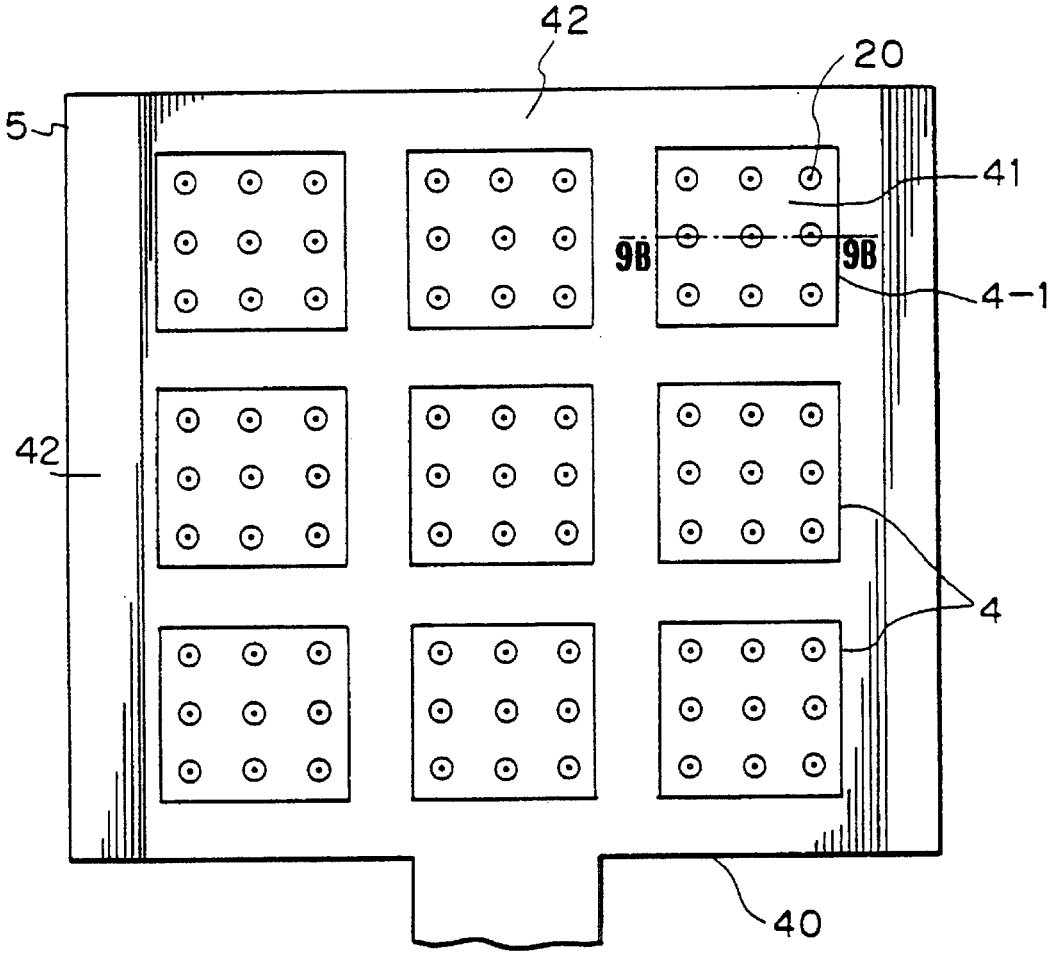
FIGS. 9(A) and 9(B) are views showing still another embodiment according to the first aspect of the invention.

This will be explained in detail with reference to FIGS. 9(A) and 9(B), in which FIG. 9(A) is a plan view showing one pixel area 5, and FIG. 9(B) a sectional view along a line 9B—9B of FIG. 9(A). The same reference numerals as those shown in previous figures represent like parts, and therefore, their explanations will not be repeated.

Figure 9B:
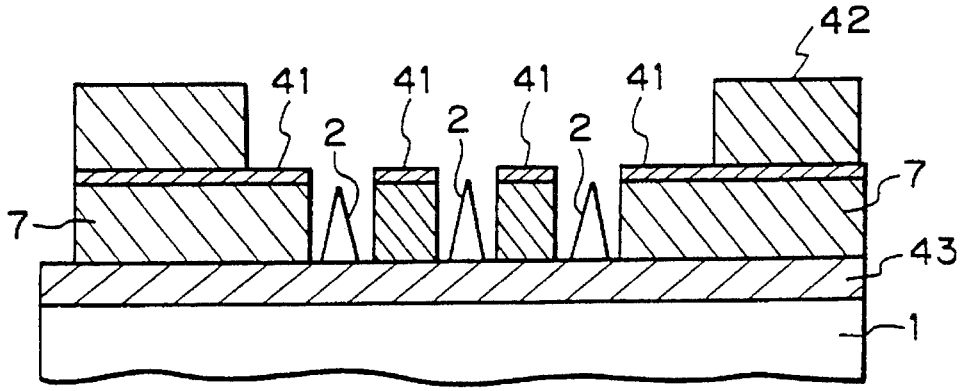

In FIGS. 9(A) and 9(B), numeral 4 is a small block (nine small blocks are arranged for each pixel area 5) involving a plurality of field emission microcathodes, 5 the pixel area, and 40 a gate electrode.

According to this embodiment, the gate electrode 40 for exciting electrons comprises the gate electrode film 41 made of high resistance material and the wiring film 42 made of low resistance material. The high resistance film 41 is disposed around the cones 2 in each small block 4, and the low resistance film 42 is disposed around the high-resistance film 41. The low resistance film 42 is electrically connected to the high resistance film 41 and serves as the wiring for setting the high resistance film 41 at a predetermined potential.

Numeral 43 denotes emitter wiring (i.e., a layer) electrically connected to the cones 2.

As mentioned before, the conventional field emission microcathode array causes the critical problem that, if a gate electrode is short-circuited to a cone, electron emission for a whole pixel is stopped.

Figure 10:
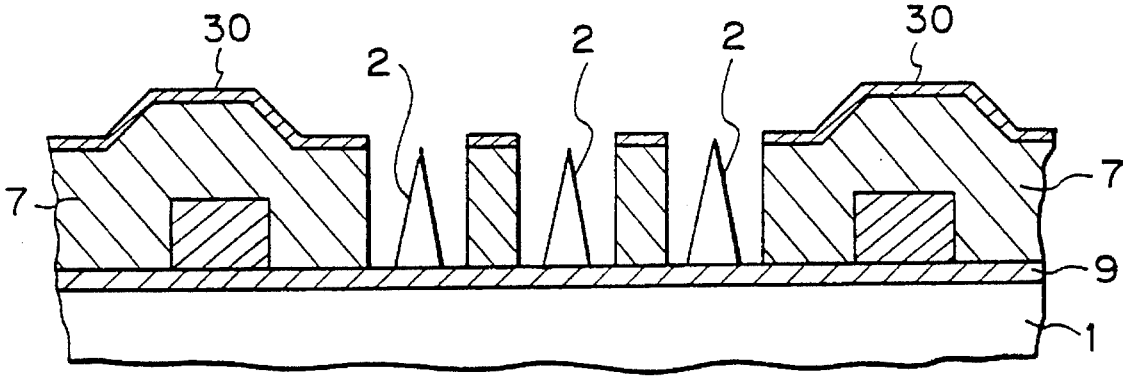
Fig. 10 PRIOR ART
FIG. 10 is a view showing a field emission microcathode and emitter wiring with a high resistance film.

FIG. 10 shows one method of solving this problem. In the figure, a high resistance film 9 serving as emitter wiring is arranged under cones 2. According to this arrangement, it is necessary to supply a large current to the emitter electrode 9 connected to the cones 2, to emit electrons from the cones 2. In other words, the emitter wiring 9 should preferably have low resistance. Arranging the high resistance film 9 under the cones 2 may solve the problem that occurs when the gate electrode is short-circuited to the cones, but it causes another problem of inferior electron emission from the cones 2. To form a large display, it is necessary to reduce the resistance of the emitter wiring. The arrangement of FIG. 10 is, however, contrary to this requirement of reducing the resistance of the emitter wiring.

The embodiment of FIG. 9 solves this problem. In the figure, the high resistance film 41 is formed on as a part of the gate electrode 40. If any one of the cones 2 is short-circuited to the gate electrode 40 in, for example, a small block 4-1 of the field emission microcathode array, the cone 2 in question and the gate electrode 41 will be electrically connected, and the emitter wiring 43 of the small block 4-1 will be subjected to a voltage drop and disabled because the gate electrode 41 corresponding to the small block 4-1 is made of a high resistance film 41-1. The cones 2 of the other small blocks 4, however, are not affected by this failure and are able to continue to operate, thereby realizing high failure redundancy.

Under normal operation and thus with no short circuit occurring, substantially no current flows to the gate electrode 40 so that no voltage drop occurs, even with the high resistance film 41 serving as the gate electrode 40, and therefore, power consumption will never increase. Namely, the function of the field emission microcathode array is not affected by the high resistance film.

The above embodiments are only examples and do not limit the present invention. Without departing from the scope of the invention, other materials, processes, and dimensions may be employed to achieve the invention.

The above embodiments arrange a lead electrode for supplying power to a gate electrode film provided for each of the small blocks in a field emission microcathode array. The lead electrode serves as a fuse, so that, even if a cone is short-circuited to the gate electrode, the failure of electron emission will be confined to and within the small block in question. In this way, dividing each pixel area into small blocks can improve the redundancy and reliability of a display unit employing the field emission microcathode array of the invention.

The gate electrode may be made of high resistance material. In this case, when a cone is short-circuited to the gate electrode, a small block containing the short-circuited gate electrode may be disabled because the cone and gate electrode are set to an equal potential. Gate electrodes of the other small blocks, however, operate normally because they are connected to low resistance material wiring. This arrangement can also improve the redundancy and reliability of a display unit employing the field emission microcathode array of the invention.

Figure 11:
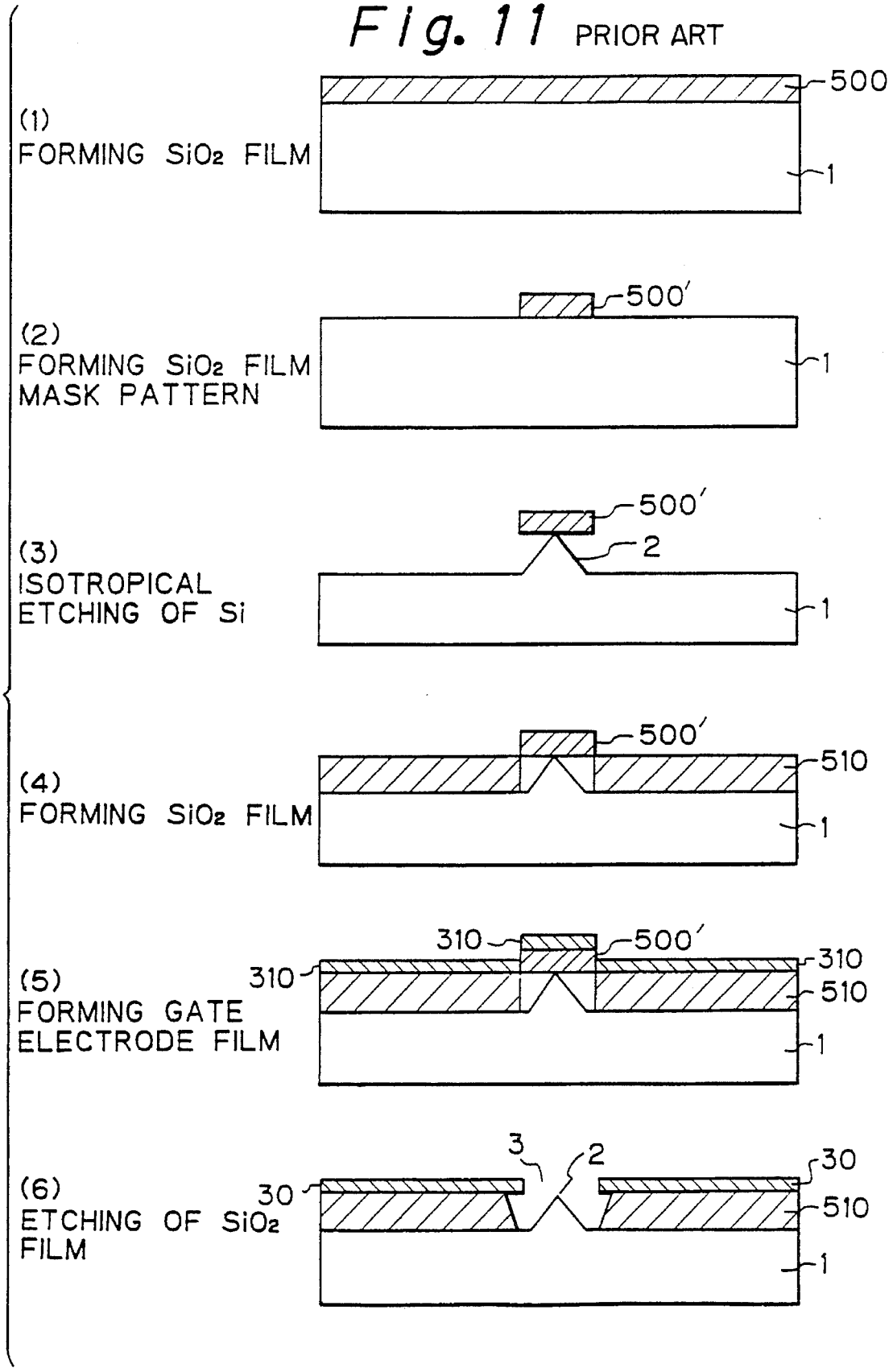
Fig. 11 PRIOR ART
FIG. 11 shows steps in fabrication of a field emission microcathode.

The field emission microcathode array according to the present invention may be made by known processes. FIGS. 11(1) to 11(6) show examples of fabrication processes. These processes form a cold cathode cone by isotropic etching of a silicon substrate (Mat. Res. Soc. Symp., Vol. 76, p. 25, 1987).

In FIG. 11 step (1), an $SiO_2$ film 500 of uniform thickness is formed on a silicon substrate 1 by known thermal oxidation.

In FIG. 11 step (2), the $SiO_2$ film 500 is etched by known photolithography into a predetermined shape and size to form an $SiO_2$ mask pattern 500'.

In FIG. 11 step (3), only silicon of the substrate is isotropically etched in a mixture of HF and $HNO_3$, to form a cone 2 serving as an emitter under the $SiO_2$ mask pattern 500'.

In FIG. 11 step (4), SiO2 is deposited or sputtering over the processed substrate to form an $SiO_2$ film 510, such that a space is formed around the cone 2.

In FIG. 11 step (5), a gate electrode film 310 made of, for example, Mo is uniformly formed by a known method. At this time, at least part of the side faces of the $SiO_2$ mask pattern 500' is exposed.

In FIG. 11 step (6), selective etching with HF is carried out to remove all of the $SiO_2$ mask pattern 500' and part of the $SiO_2$ film 510. As a result, an opening 3 is formed, and the cone 2 is exposed in the space. This completes the formation of a field emission microcathode on the silicon substrate.

Although the above explanations relate to a single cathode, an array of cathodes can be formed on a substrate by employing a proper mask and known photolithography technique.

In the fabrication processes mentioned above, the positional relationship between each cone 2 and a corresponding opening 3 formed on the gate electrode 30 is very important. The tip of the cone 2 must agree with the center of the opening 3. This agreement may be relatively easy to achieve, but one problem is that the diameter or the width of a circular or rectangular gate electrode opening may fluctuate depending on fabrication conditions. This fluctuation is unavoidable even with strict designing. If the diameter of each opening 3 of the gate electrode 30 fluctuates, a required emission current may not be obtained.

Referring again to FIG. 6, operational characteristics of the field emission microcathode are determined by the radius Rg of the gate electrode opening 3, the height Ht of the cone 2, and the thickness Hg of the gate insulation film. In the figure, the ordinate represents the emission current Ie, and a abscissa, the gate voltage Vg.

Figure 6:
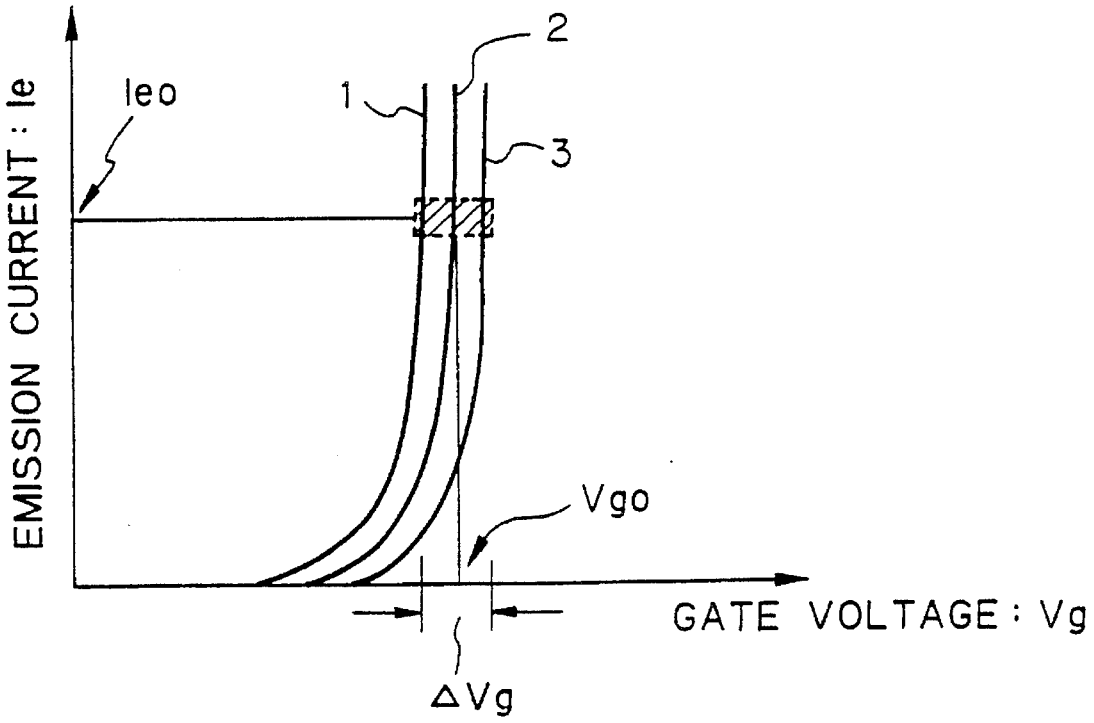

A curve (1) in FIG. 6 represents a typical example with the diameter of the opening 3 being equal to a required value. When a voltage is applied and increased with the cone 2 being negative and the gate 30 positive, the tip 20 of the cone 2 suddenly emits electrons at a certain threshold voltage. At an operational gate voltage of Vgo, an operational emission current of Ieo is obtained.

If the diameter of any opening 3 of the gate electrode is larger than the required value as indicated with a curve (3) of FIG. 6, or smaller as indicated with a curve (2), an emission current obtained from the same gate voltage drastically decreases to an unacceptable level.

When fabricating the cones 2 according to the invention, the above problem is not conspicuous when the number of the cones 2 is small, because the height Ht of the cone 2 and the diameter 2Rg of the gate electrode opening 3 are each several micrometers or smaller. When forming many cones in a large area, or preparing a long linear edge, the above problem may arise in the processes of deposition, exposure, etching, etc.

If the size of the gate electrode opening is larger or smaller than the optimum value, an emission current will be very small. Namely, a sufficient emission current is not obtained if the diameter of the gate electrode opening deviates from the optimum value. As a result, the production yield of field emission microcathode arrays having required characteristics deteriorates.

To solve this problem, the second aspect of the invention provides a field emission microcathode array comprising a substrate over which a plurality of cones each having a sharp tip are formed, and a gate electrode having a plurality of openings, each opening surrounding the tip of a corresponding cone. The tip of each cone emits electron beams because of field emission. The plural openings of the gate electrode have respectives, different sizes and are intermingled over the gate electrode.

More precisely, the second aspect of the invention provides a field emission microcathode array comprising a substrate 1 on which cones 2 each having a sharp tip are formed, and gate electrode openings 3 each surrounding the tip 20 of a corresponding cone 2. The tip 20 of each cone 2 emits electron beams because of field emission. The gate electrode openings 3 have respectives different sizes and are intermingled over the substrate.

Also, the second aspect of the invention provides a field emission microcathode comprising a substrate through which a groove-like (i.e., elongated) gate electrode opening 5 is formed surrounding the edge 40 of a blade-shaped emitter electrode 4. A blade 40; the edge 40 emits electron beams because of field emission. The width of the gate electrode opening 5 varies along the length thereof. A plurality of the field emission microcathodes may be arranged in an array on the substrate.

Figure 12:
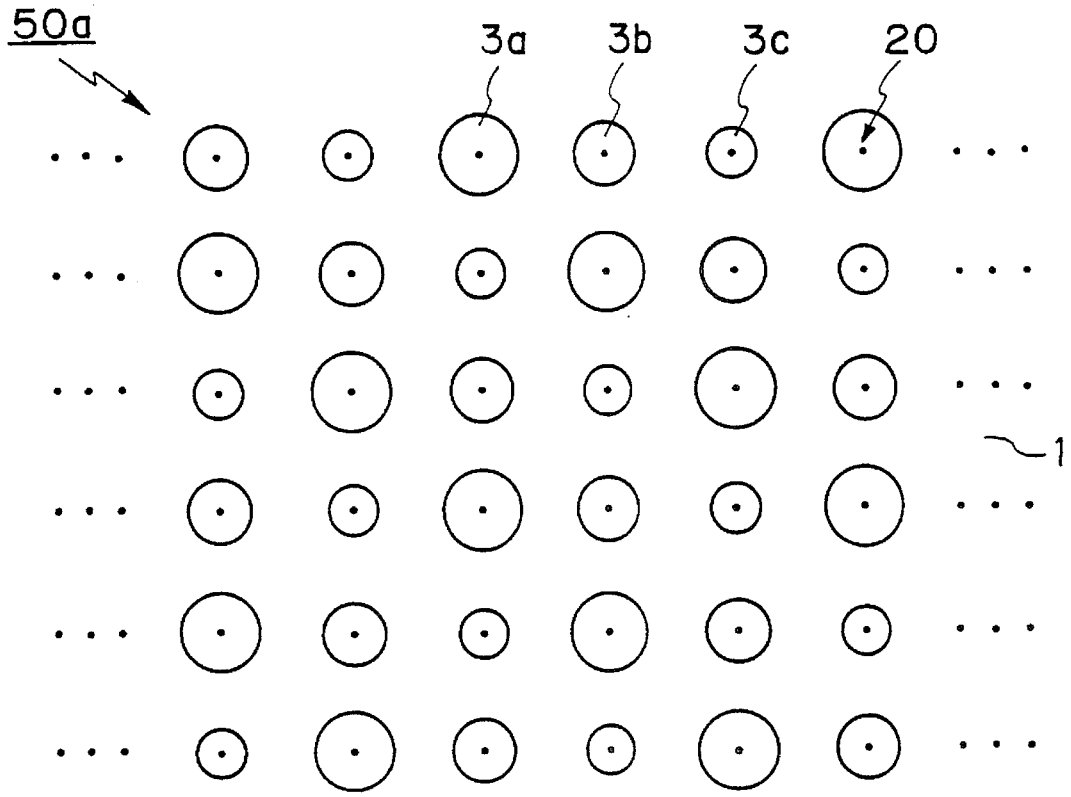
FIG. 12 is a view showing an embodiment according to the second aspect of the invention.

FIG. 12 shows an embodiment according to the second aspect of the invention. This figure simply shows an arrangement of tips 20 of cones and corresponding gate electrode openings 3 that form a field emission microcathode array 50*a*. The openings 3 are of three different, respective sizes. Namely, they are classified into large-sized openings 3*a*, middle-sized openings 3*b*, and small-sized openings 3*c* arranged in a repeating pattern cyclically. This arrangement may be fabricated according to, for example, the processes explained with reference to FIGS. 11(1) to 11(6). The sizes and intervals of the openings 3 are selected according to requirements.

This embodiment positively forms the openings 3 having different sizes, determined relatively to a required or optumum size. It is preferable to prepare at least three opening sizes, including sizes respectively above and below the required size. It is possible to prepare more than three sizes. The openings 3 having different sizes may be randomly distributed or somewhat regularly arranged on the gate electrode 30.

Even if some openings with one of the three sizes deviate from the required value, other openings with another size may agree with the required value, so that the field emission microcathode array as a whole will not be useless or rejected. Although this method may reduce the number of normally operating microcathodes to one third, this disadvantage can be written off by its cost saving effect.

Figure 1A:
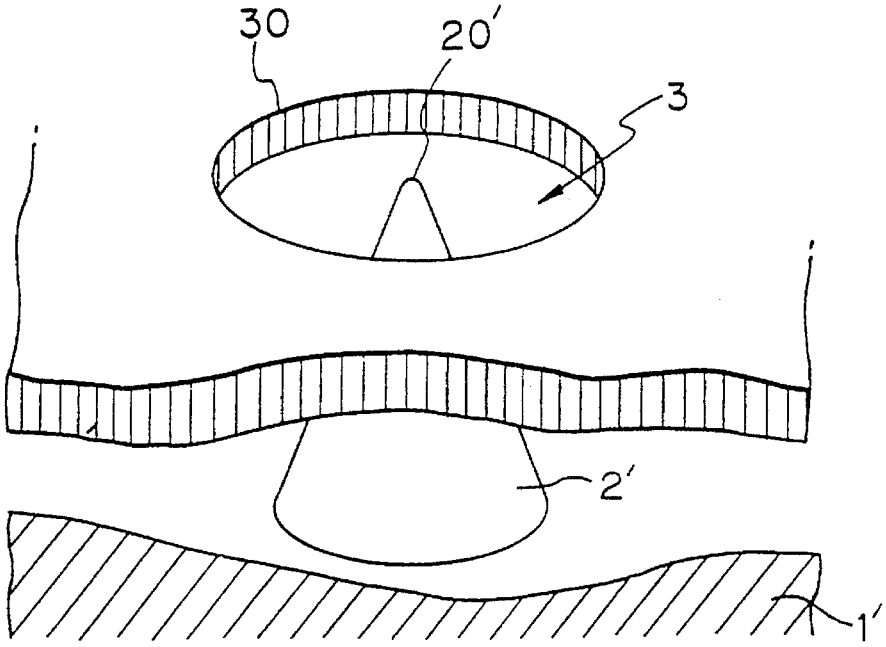
Fig. 1A PRIOR ART
FIGS. 1(A) and 1(B) are views showing a structure of a field emission microcathode.
Figure 1B:
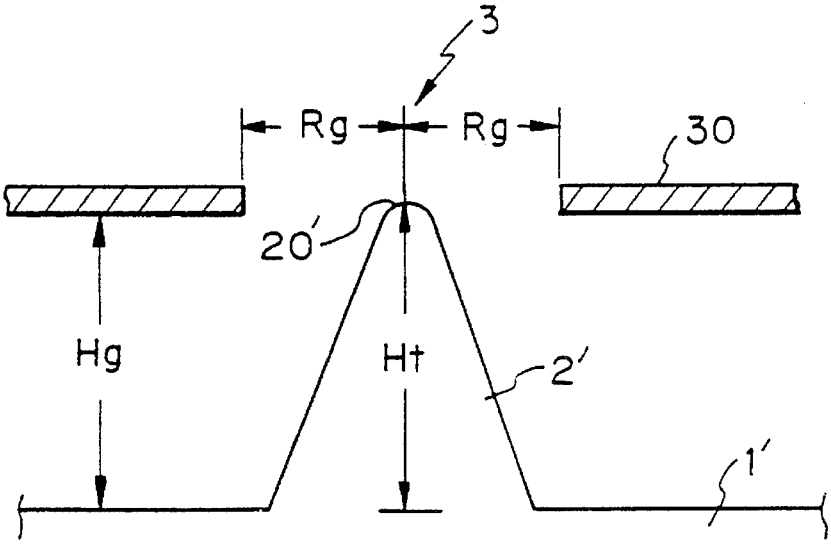
Fig. 1B PRIOR ART
Figure 2A:
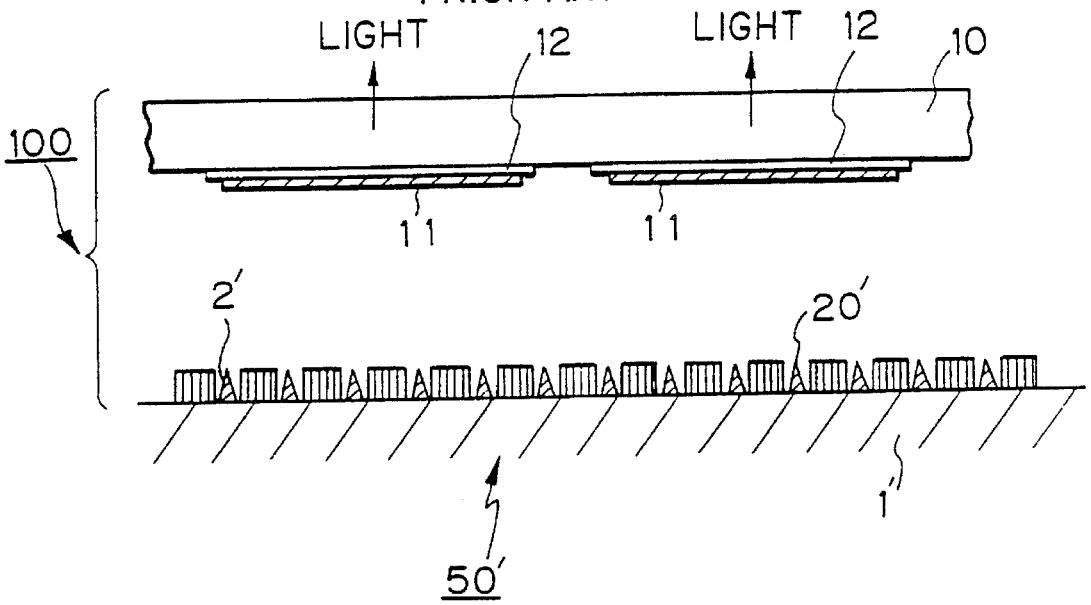
Fig. 2A PRIOR ART
FIGS. 2(A) and 2(B) are views showing a field emission microcathode array.
Figure 2B:
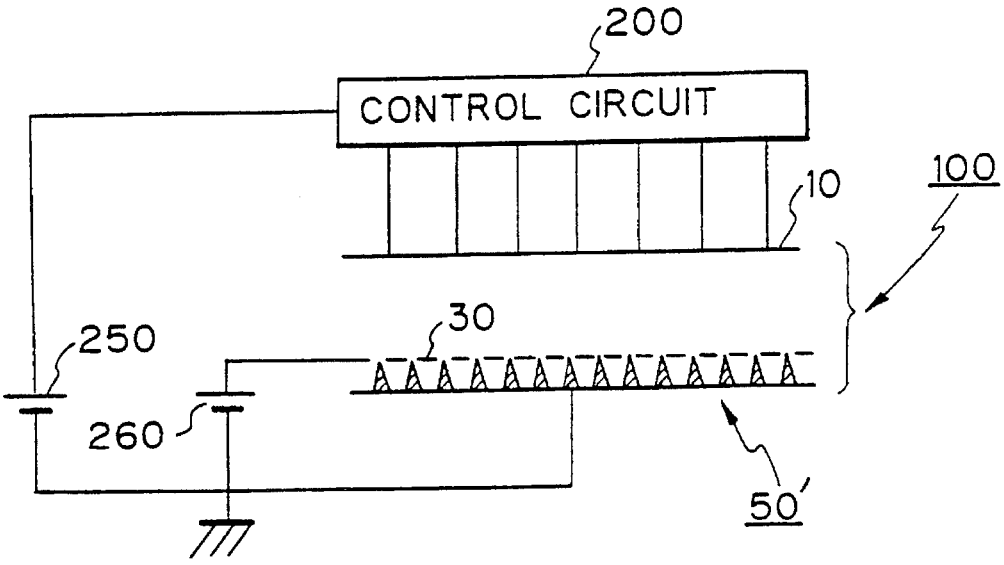
Fig. 2B PRIOR ART
Figure 3B:
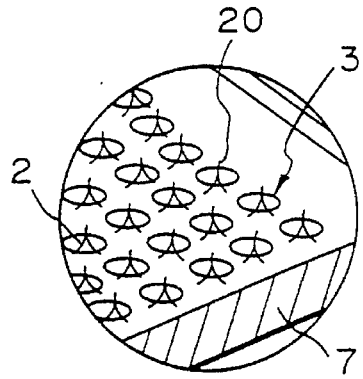
Fig. 3B PRIOR ART
FIGS. 3(A) to 3(C) are views showing a conventional field emission microcathode array, and thus according to a prior art.
Figure 3A:
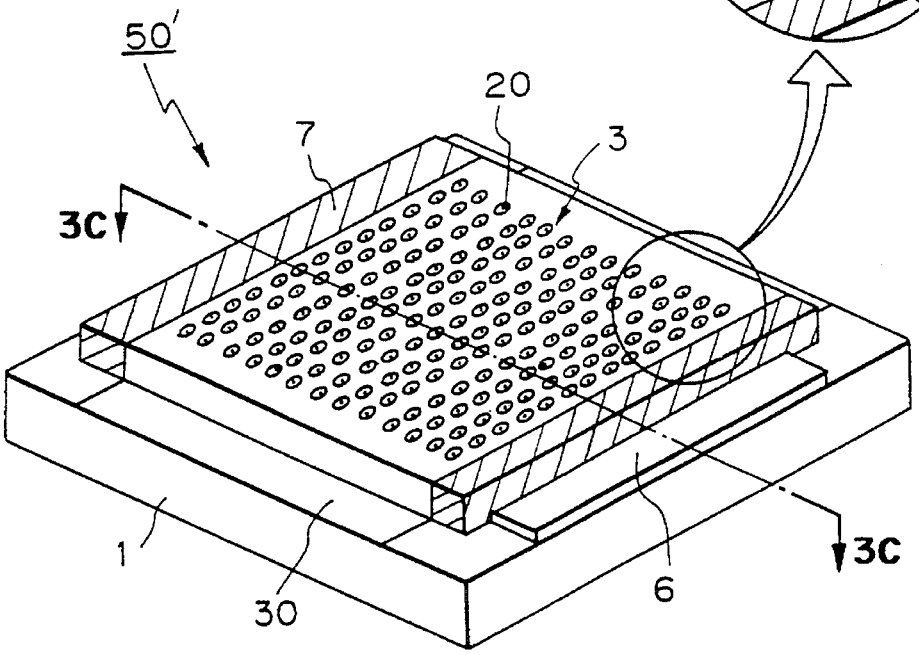
Fig. 3A PRIOR ART
Figure 3C:
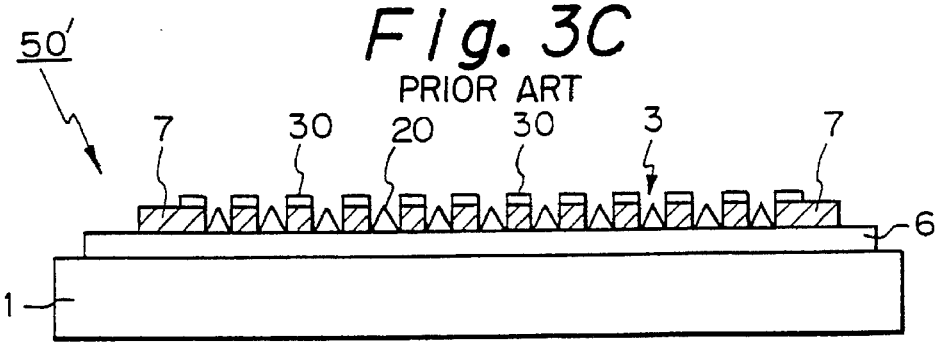
Fig. 3C PRIOR ART
Figure 4:
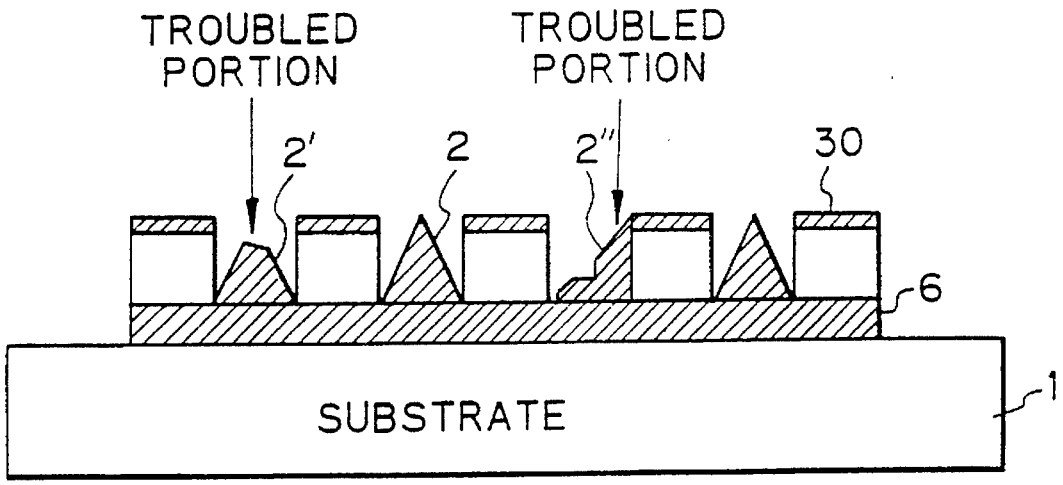
Fig. 4 PRIOR ART
FIG. 4 is a view showing problems of the conventional field emission microcathode array.
Figure 5:
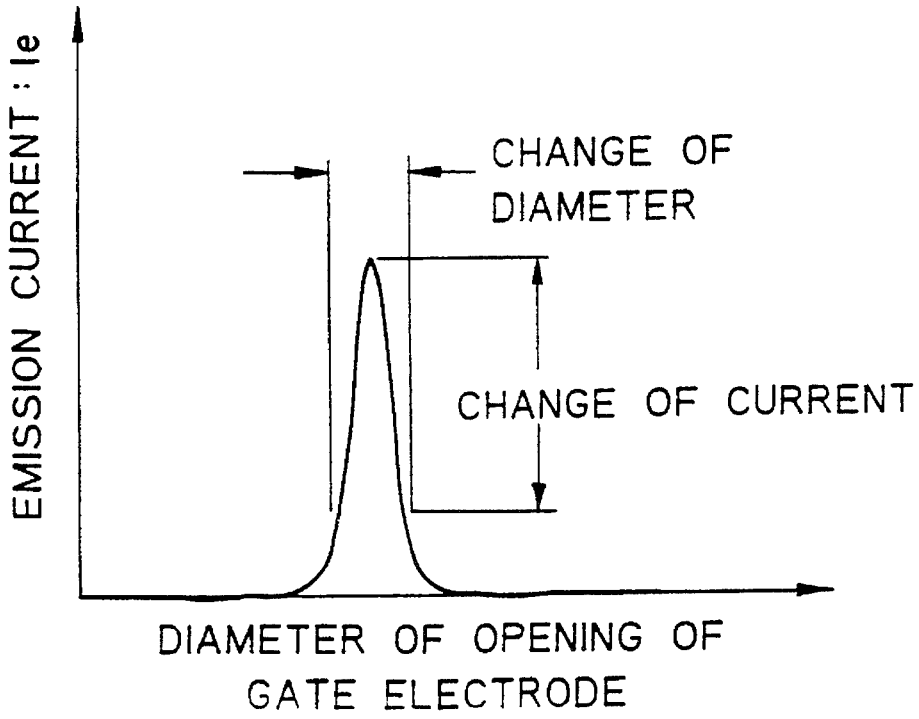
FIGS. 5 and 6 are views showing a relationship between the diameter of a gate electrode and an emission current in a conventional field emission microcathode.
Figure 14:
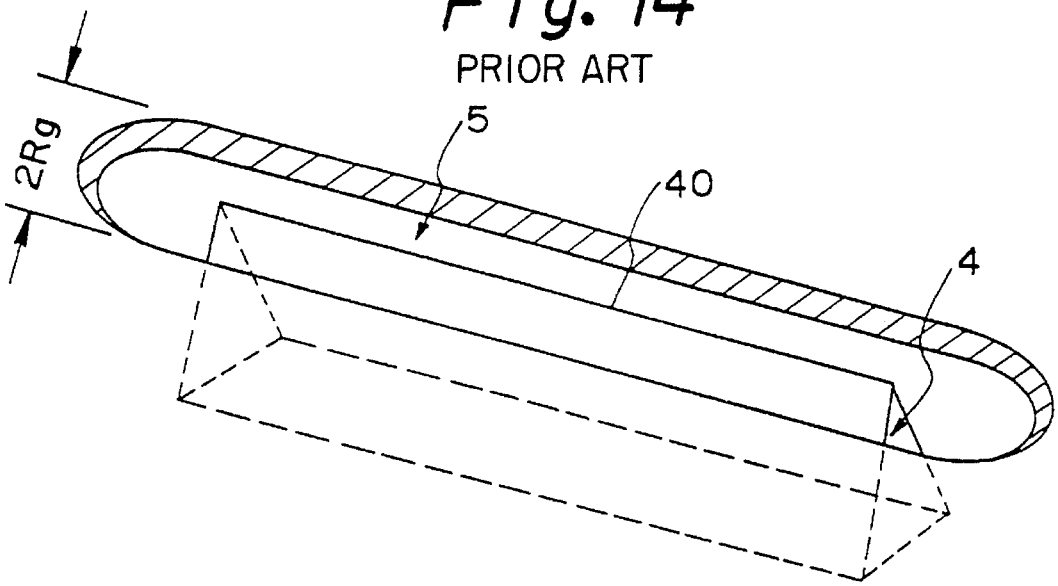
Fig. 14 PRIOR ART
FIG. 14 is a view showing another structure of a field emission microcathode.

FIG. 14 shows another structure of a pior art field emission microcathode. In FIG. 1, each emitter is conical, while in FIG. 14 an emitter 4 has a blade-shape with an edge 40 which linearly emits electrons. Accordingly, a gate electrode opening 5 is shaped into a long thin groove having a width of 2Rg. This example is appropriate for emitting a linear beam.

Figure 15:
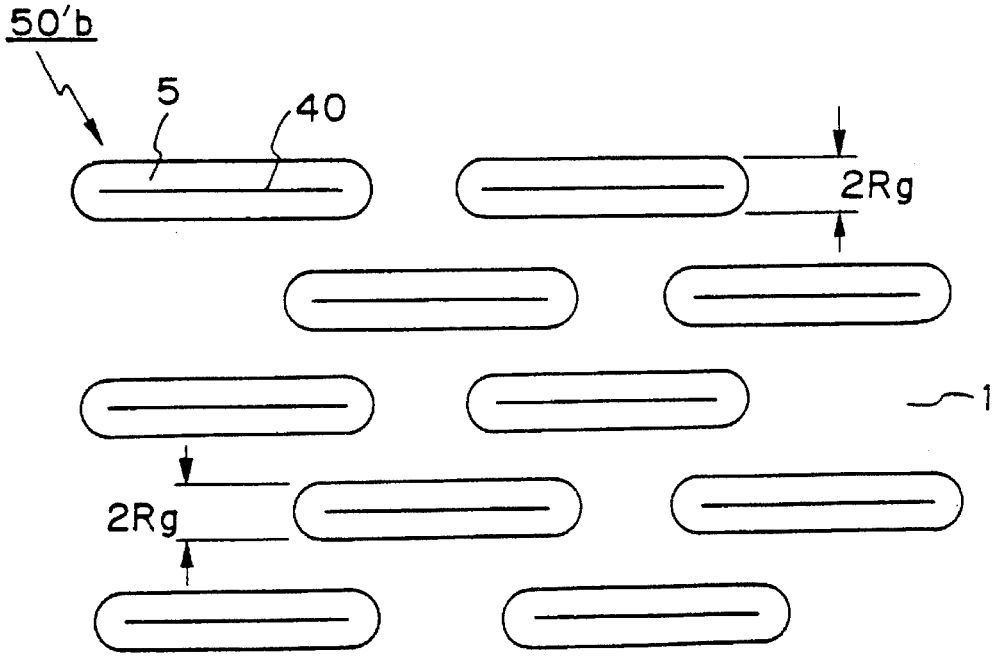
Fig. 15 PRIOR ART
FIG. 15 is a view showing openings formed on a gate electrode of a field emission microcathode array according to a prior art.

FIG. 15 shows gate electrode openings of a field emission microcathode array according to a prior art. This figure simply shows electrode blade edges 40 centrally disposed in corresponding gate electrode openings 5 that form a field emission microcathode array 50'*b*. Details of each cathode are the same as those of FIG. 14. This example emits electron beams in a wide area.

The example of FIG. 15 has the same problem as that explained with reference to FIG. 6. To solve the problem, the present invention proposes arrangements as shown in FIGS. 13 and 16.

Figure 13:
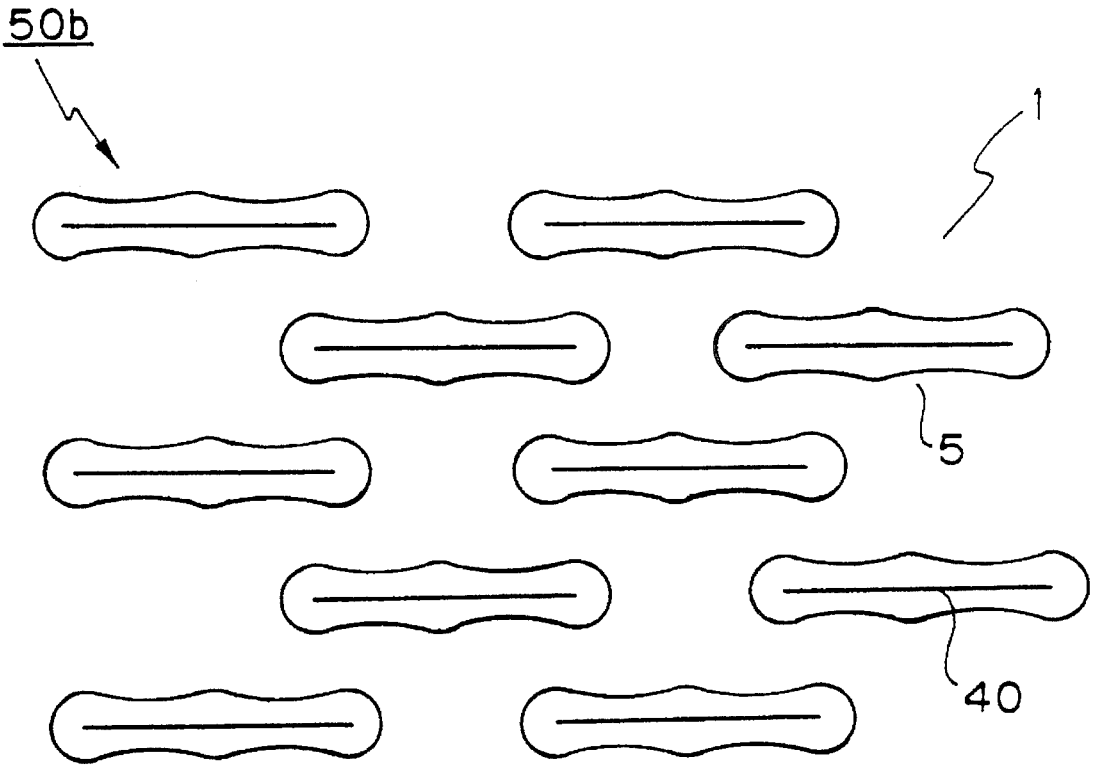
FIG. 13 is a view showing another embodiment according to the second aspect of the invention.

FIG. 13 schematically shows electrode blade edges 40 centrally disposed in corresponding gate electrode openings 5 that form a field emission microcathode array 50*b* according to the second aspect of the invention. This embodiment resembles the prior art of FIG. 15. According to the embodiment of FIG. 13, however, the width of the opening 5 is irregular along the length of the blade edge 40 of the emitter 4. Optimum width portions of the opening 5 relative to the blade edge 40 may self-selectively emit electrons. This is true for every blade edge 40 and opening 5 so that electron beams are stably emitted from a large area.

Figure 16:
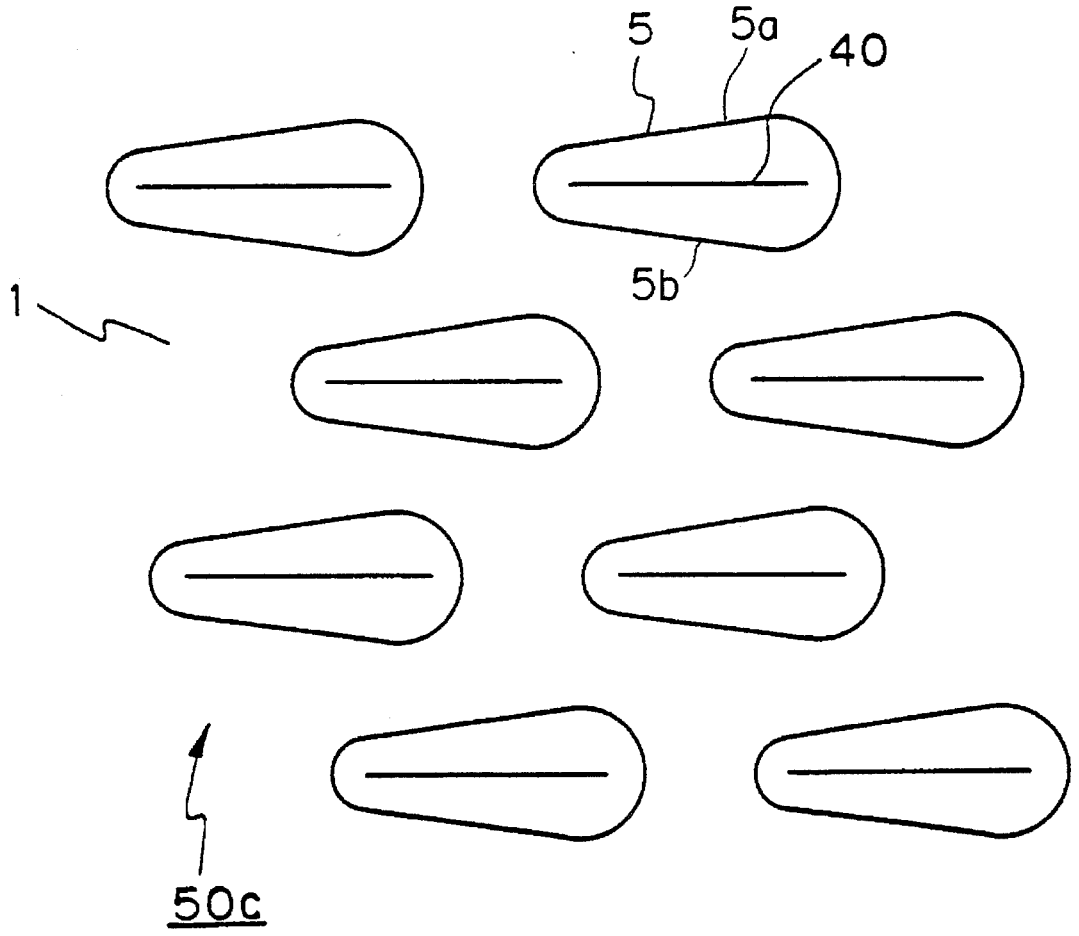
FIG. 16 is a view showing still another embodiment according to the second aspect of the invention.

FIG. 16 shows a modification of the embodiment of FIG. 13. In this modification, the opposed edges 5*a*, 5*b* defining the width of an opening 5 are tapered relatively to each other and symmetrically, relatively to and along the length of the blade edge 40. At optimum width portion of the opening, electron beams are self-selectively emitted.

The above two embodiments employ an array of emitter edges. The present invention is also applicable for a single long linear field emission cathode.

As explained above, the present invention prepares large-middle-, and small-sized gate electrode openings 3 (5) and distributes them over the substrate. Even if the respective sizes of the openings fluctuate because of fabrication errors, some cones 2 or blade edges 40 will have respective gate openings of the optimum radius Rgo or width of 2Rgo and will self-selectively emit electron beams. In this way, the embodiments stably emit electron beams from a wide area or along a long line.

Next, a printer employing the field emission microcathode array according to the present invention will be explained.

Non-impact printers such as laser printers using optical line beams are rapidly spreading these days. The laser printers require a device for guiding a light beam to many positions. Methods of guiding a light beam to many positions include a light beam scanning method and an optical array method.

The optical array method arranges many light emitting elements, such as laser diodes, as corresponding optical points, such as printing dots. The optical array method contributes to high-speed and low-noise printing.

The light beam scanning method scans an object with a light beam by rotating a light deflecting element such as a rotary polygon mirror and a hologram disk. This method is most widely used because it provides high resolution and a wide scanning angle.

Figure 17:
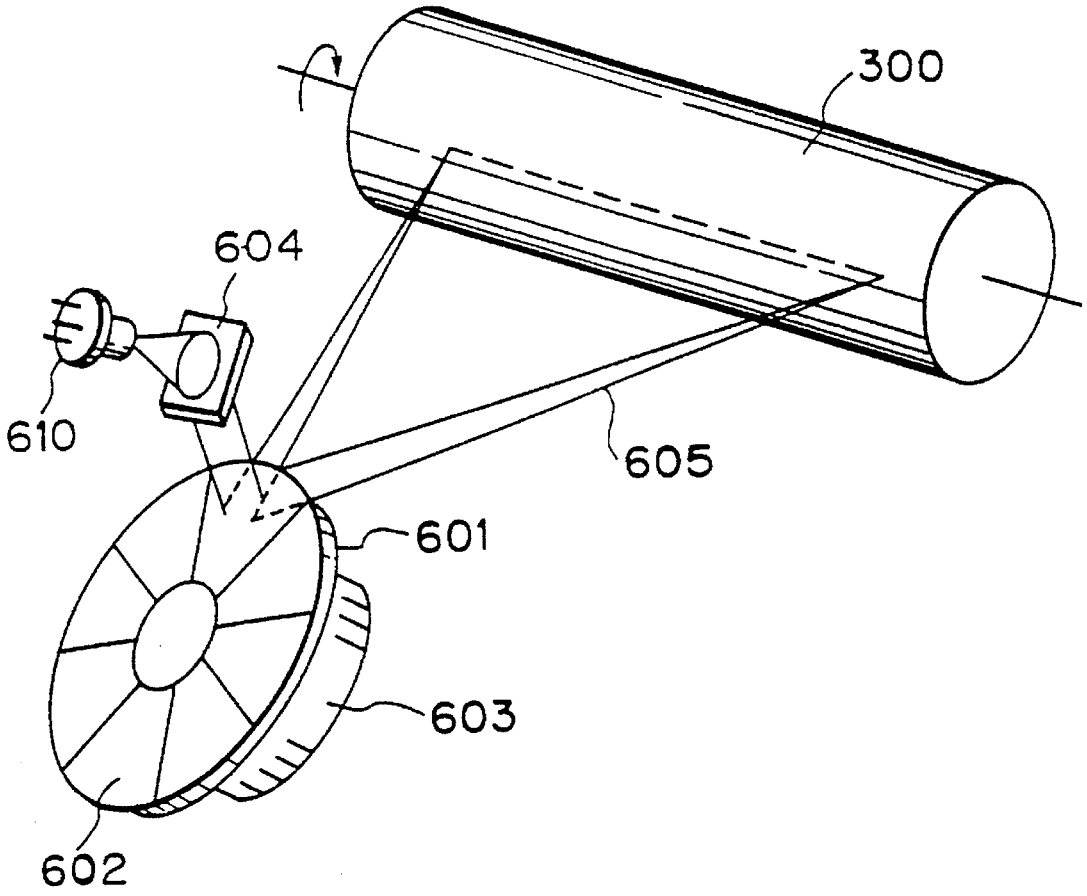
Fig. 17 PRIOR ART
FIG. 17 is a view showing an optical system of an optical printer according to a prior art.

An example of an optical printer employing the light beam scanning method and a hologram will be roughly explained with reference to FIG. 17. A light source 610 such as a semiconductor laser emits a laser beam, which is converged by a convergent lens 604 such as a hologram lens into a predetermined diameter. At the same time, aberration of the beam is corrected. The beam is then made incident on a hologram 602 formed on a hologram disk 601. The hologram disk 601 is rotated by a motor 603. According to the rotation of the hologram disk 601, the incident beam is deflected by the hologram 602 in different directions. Accordingly, an outgoing beam 605 scans the surface of a photoconductor drum 300. Other devices such as a charger, developing unit, and sheet feeding mechanism necessary for forming the electrostatic recording optical printer are not shown in FIG. 17 for the sake of simplicity.

On the other hand, the conventional optical array method for optical printers is inferior in brightness, resolution, and cost.

The light beam scanning method mentioned above must employ a precision motor and fine rotation control mechanism for rotary elements, such as the rotary polygon mirror and hologram disk, to meet high-quality printing requirements. This may increase the size and cost of the apparatus.

Figure 18:
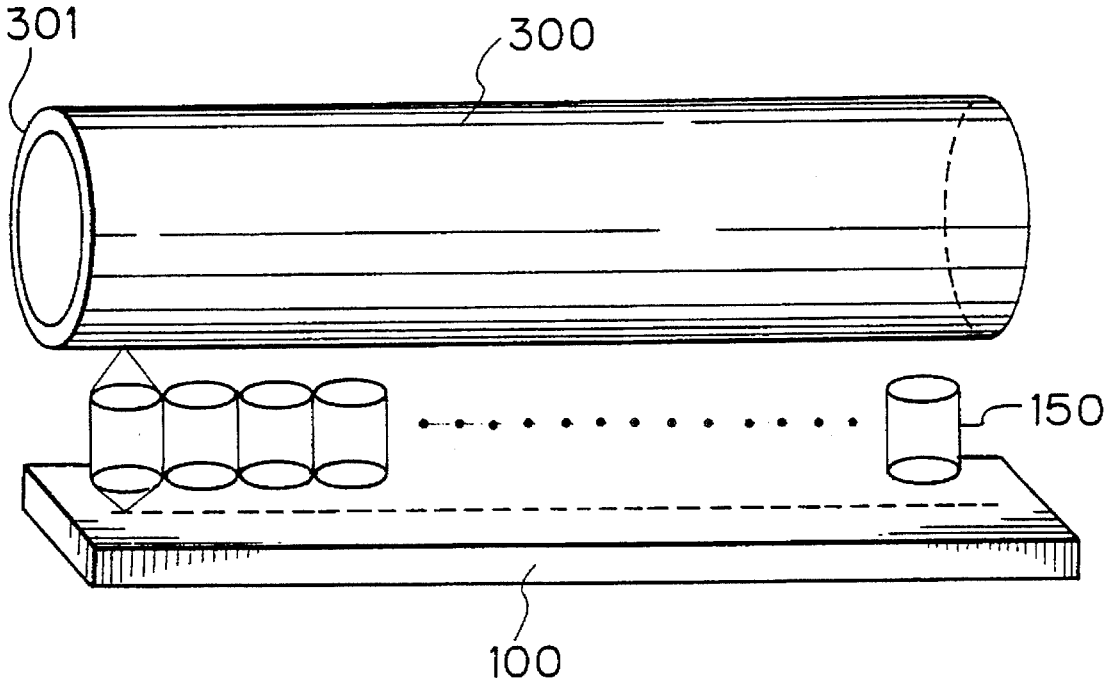
FIG. 18 is a view showing essential parts of an optical printer according to the invention.

These problems are solved by an optical printer as shown in FIG. 18 and which comprises a field emission cathode type optical head 100 (FIG. 19) including a fluorescent dot array and field emission microcathodes for emitting corresponding electron beams toward the fluorescent dot array, a control circuit 200 (FIG. 20) for turning on and off the optical head 100, and a photoconductor drum 300 having a photoconductor 301 on which a latent image is formed by means of the turned on and off optical head 100 (FIG. 18). The optical head 100 is formed of the field emission microcathode array or the edge type field emission microcathodes according to the present invention.

The optical head 100, including the field emission microcathodes and fluorescent elements, makes the optical printer compact and provides low power consumption, a high degree of brightness, and a stable operation with no mechanically moving parts. These advantages are strengthened by the field emission microcathode array or the edge type field emission microcathodes of the present invention that constitute the optical head 100.

Next, optical printers employing the field emission microcathode array or the edge type field emission microcathodes of the invention will be explained.

FIG. 18 is a view showing an essential part of an optical printer according to the present invention. Numeral 100 denotes a field emission cathode type optical head, 150 an array of lenses such as equal magnification erect lenses, 300 a photoconductor drum, and 301 a photoconductor.

The optical head 100 comprises a fluorescent dot array (not shown) and a field emission microcathode array (not shown) for emitting electron beams to the fluorescent dot array. The optical head 100 is turned on and off by a control circuit (not shown), and the lens array 150 forms a latent image on the photoconductor 301 such as a Zno:Zn film coated around the photoconductor drum 300. Other devices such as a charger, developing unit, and sheet feeding mechanism necessary for the optical printer are not shown in the figure for the sake of simplicity, because these devices do not directly relate to the present invention.

Figure 19:
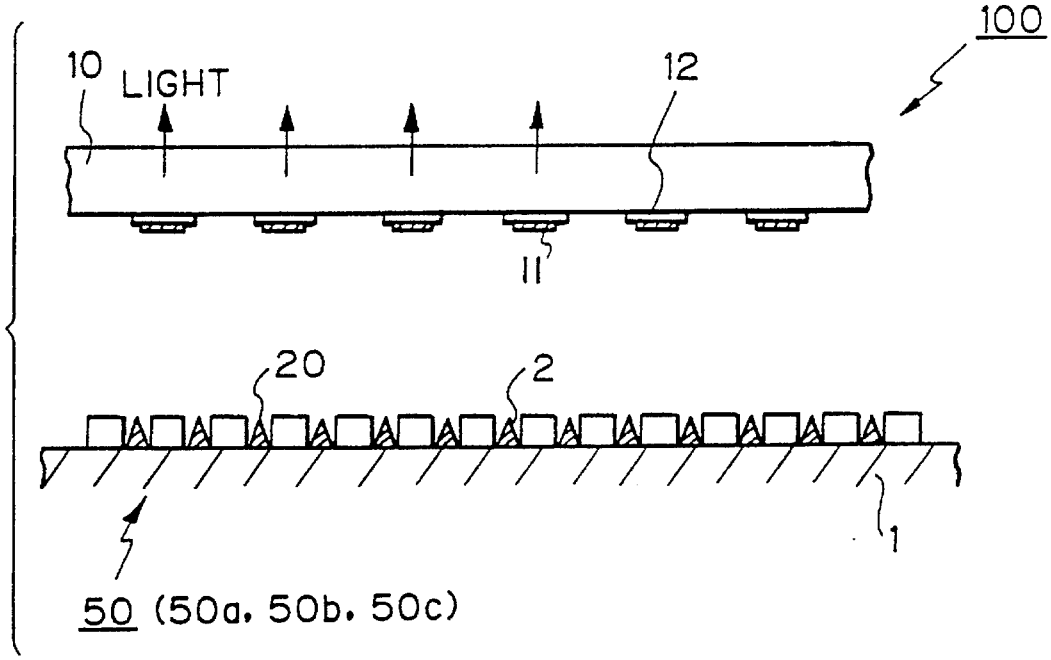
FIG. 19 is a view showing essential parts of a printer according to an embodiment of the invention.

FIG. 19 shows an embodiment of a field emission microcathode array applied to the printer, according to the present invention. Numeral 10 denotes a transparent substrate such as a glass substrate, and 12 denotes anodes formed on the transparent substrate 10. Each of the anodes 12 is made of, for example, an ITO ($In_2O_3$—$SnO_2$) film having a thickness of 200 to 300 nm and a size of about 50 μm. The anodes 12 correspond to printing dots and are arranged at pitches of about 70 μm. On each of the anodes 12, there is arranged a fluorescent dot 11, which is smaller than the anode 12 and made of a ZnO:Zn film having a thickness of 2 μm.

Numeral 50 denotes the field emission microcathode array, formed on the substrate 1 at predetermined dimensions and pitches. The array 50 is fabricated according to, for example, a method disclosed by the present inventors (Institute of Electronics, Information and Communication Engineers of Japan, Autumn National Convention, 1990, SC-8-2, 5-28-2).

The substrates 10 and 1 are spaced apart from each other by a distance of about 200 μm, to form a field emission cathode type head 100. This head is arranged as shown in FIG. 18 and assembled with a control circuit, charger, developing unit, sheet feeding mechanism, etc., to form an optical printer.

Figure 20:
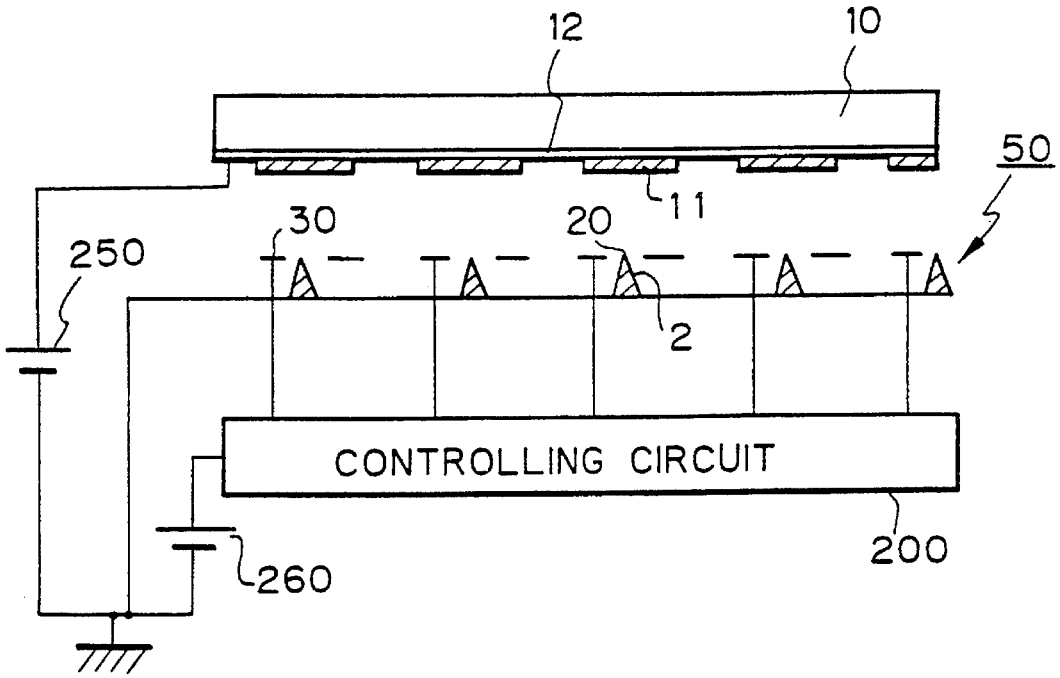
FIG. 20 is a view explaining a method of driving the printer of FIG. 19.

FIG. 20 shows a method of driving the embodiment of FIG. 19, according to the present invention. Numeral 30 denotes a gate electrode and 200 a control circuit for turning on and off the field emission cathode type optical head 100. In this embodiment, the control circuit 200 is a gate selection circuit. Numeral 250 denotes an anode power source, and 260, a gate power source.

The gate power source 260 selectively applies a gate voltage to a specific cone 2 selected by the gate selection control circuit 200 whose tip 20 then emits electrons emitted by the specific, selected cone 2. The electrons are attracted by an anode 12, the anode 12 being energized to positive potential by the anode power source 250. Accordingly, a fluorescent dot 11 formed on the anode 12 and corresponding to the specific, selected cone 2 emits light. In this way, the control circuit 200 may properly select a gate 30 to which a gate voltage is applied, to thereby emit light from an optional (i.e., selected) fluorescent dot 11.

In this embodiment, each cone 2 serves as an emitter. With the diameter of each opening 3 being 2 μm and a pitch between the tips 20 of the cones 4 μm, electron beams are selectively emitted when a selecting gate voltage Vg of 80 V and an anode voltage Va of 100 V are applied. The present invention employs the control circuit 200 to provide a high performance optical printer that achieves greater brightness than those employing the conventional optical accessing methods.

Figure 21:
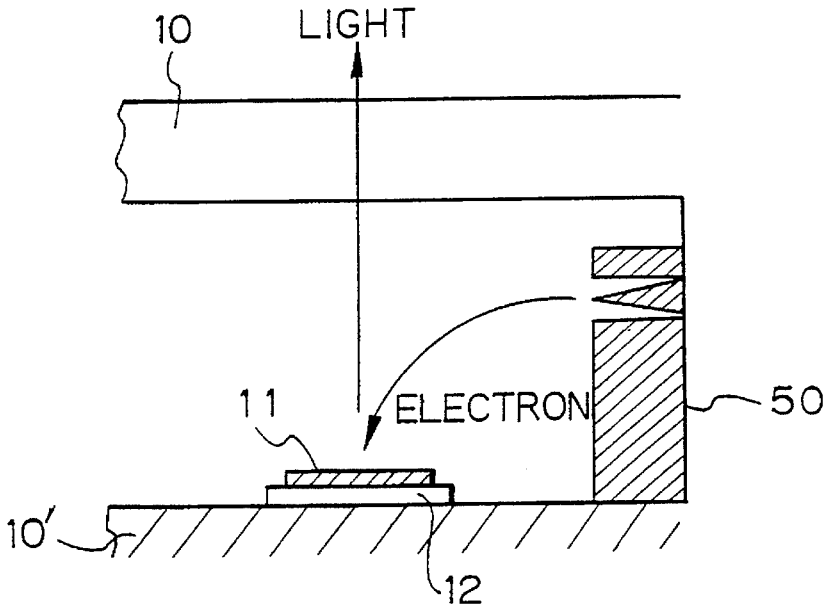
FIG. 21 is a view showing essential parts of a printer according to another embodiment of the invention.

FIG. 21 is a schematic view showing essential parts of a printer according to still another embodiment of the invention. A field emission microcathode array 50 is arranged orthogonally to a fluorescent dot 11, so that electron beams may be emitted toward the fluorescent dot 11 from the side thereof. This embodiment improves light emission efficiency because the electron beams are not attenuated by the fluorescent dot 11.

Figure 22:
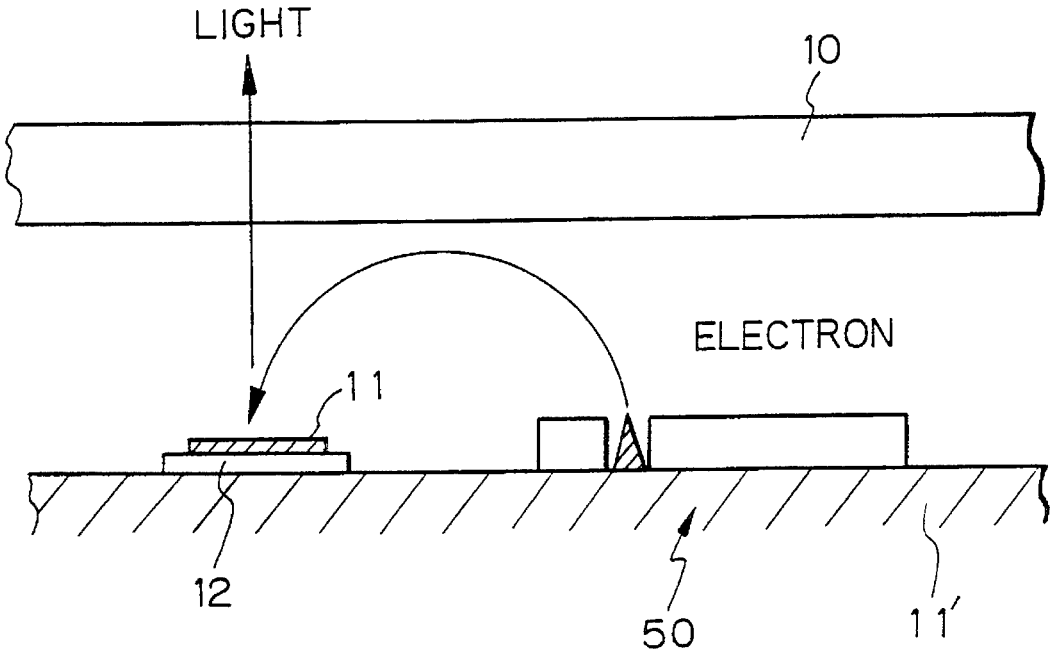
FIG. 22 is a view showing essential parts of a printer according to still another embodiment of the invention.

FIG. 22 is a schematic view showing essential parts of a printer according to a modification of the embodiment of FIG. 21. A fluorescent dot 11 and a field emission microcathode array 50 are formed on the same plane. This modification improves light emission efficiency and is easy to fabricate because the two elements are formed on the same plane. The modification improves production yield and decreases cost.

Figure 23:
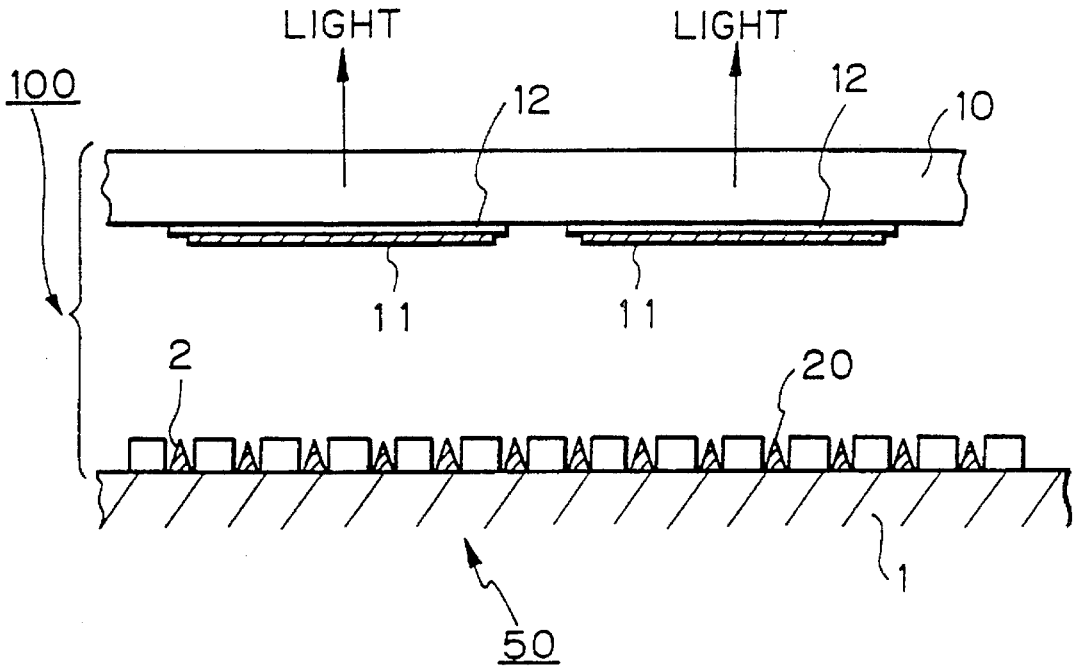
FIG. 23 is a view showing essential parts of a printer according to still another embodiment of the invention.

FIG. 23 is a schematic view showing an essential part of a printer according to still another embodiment of the invention. The same reference numerals as those used for the previous embodiments represent like parts.

A field emission microcathode array 50 can be made very small by IC technology. For example, the tip of a cone 2 may have a size of about several micrometers. On the other hand, the size of a fluorescent dot 11 corresponding to a printing dot has a size of several tens to hundreds of micrometers. It is possible, therefore, to arrange many cones 2 in correspondence to each fluorescent dot 11, as shown in the figure. This arrangement can increase the number of electron beams for irradiating each fluorescent dot 11 and improve the redundancy and reliability of the printer as a whole.

Figure 24:
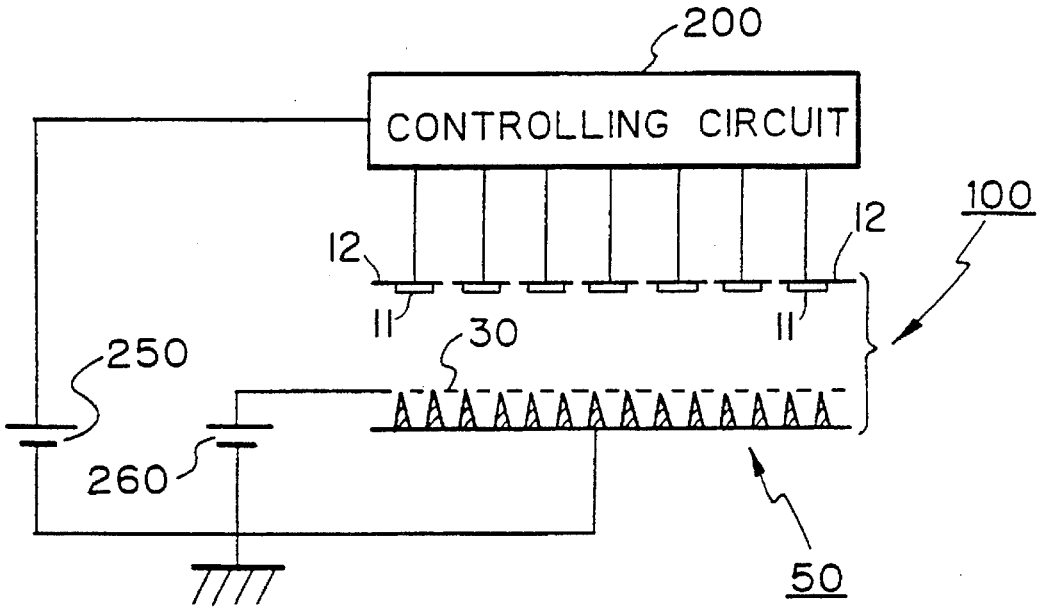
FIG. 24 is a view explaining a method of driving the printer of FIG. 23.

FIG. 24 shows a method of driving the embodiment of FIG. 23. What is different in FIG. 24 from the driving method of FIG. 20 is that a control circuit 200 serves not as a gate selection circuit but as an anode selection circuit. A gate voltage applied by a gate power source 260 causes electrons to be simultaneously emitted. The electrons are attracted by a specific anode 12 selected by the control circuit 200. The electrons then permit a fluorescent dot 11 on the anode 12 emit light. The anode 12, to which positive potential is applied, is properly selected by the control circuit 200, so that light may be emitted from a required fluorescent dot 11. This embodiment provides a printer with greater performance and brightness compared with the conventional optical accessing methods.

Although not shown, the field emission cathode type head 100 according to the invention may employ a field emission microcathode array 50 with intermingled gate electrode openings 3 (5) of different sizes, to further improve the efficiency of the printer.

All of the above embodiments have been presented as examples, and the present invention is not limited to these embodiments. Without departing from the scope of the invention, other materials, processes, configurations may be employed to achieve the invention.

The field emission cathode type optical head including the field emission microcathodes and fluorescent dots serves as a light source of an optical printer and makes the printer compact, and provides low power consumption, a high degree of brightness, and a stable operation with no mechanically moving parts. The field emission microcathode array or the edge type field emission microcathodes of the present invention serve to strengthen these advantages of the optical head, simplify the structure, stabilize the performance and lower the cost of the printer.

We claim:

1. A field emission microcathode array comprising:

a substrate having a main surface;

a plurality of cones formed on the main surface of the substrate and arranged in a plurality of blocks, each of said blocks comprising a plurality of respective cones and each of said cones having a sharp tip and emitting an electron beam from the sharp tip thereof when induced by field emission;

a gate electrode comprising a plurality of electrically and structurally independent gate electrode portions respectively corresponding to the plurality of blocks, each of said gate electrode portions having a plurality of openings therein corresponding to the plurality of cones of the respective one of the blocks and each of said openings being aligned with and disposed in surrounding relationship relatively to the corresponding tip of the respectively associated one of the cones; and a plurality of lead electrodes respectively connected to the plurality of gate electrode portions, each of said lead electrodes being configured as a fuse and providing an independent connection of the respective one of the gate electrode portions to a common power source.

2. A field emission microcathode array according to claim 1, wherein the gate electrode further comprises:

a main electrode portion connected to the power source, the plurality of gate electrode portions being disposed within the main electrode portion, and a groove isolating each of the plurality of gate electrode portions from the main electrode portion and from each of the other gate electrode portions; and the plurality of lead electrodes comprises a plurality of conductor elements of electrically conductive material respectively corresponding to the plurality of gate electrode portions, each conductor element of the plurality of conductor elements connecting the respectively corresponding one of the gate electrode portions to the main electrode portion.

3. A field emission microcathode array according to claim 1, wherein the main electrode portion and the plurality of gate electrode portions are formed on the main surface of the substrate.

4. A field emission microcathode array according to claim 2, wherein the plurality of elements of electrically conductive material comprise respectively corresponding, integral portions of the gate electrode.

5. A field emission microcathode array according to claim 2, wherein the electrically conductive material of the plurality of elements is a low-melting temperature material relative to the melting temperature of the material of the gate electrode.

6. A field emission microcathode array according to claim 2, wherein the connection provided by each conductor element has a first current-carrying capability such that a current conducted thereby in excess of the first current-carrying capability causes the connection to be ruptured and wherein, when a cone is short-circuited to the corresponding gate electrode portion of the respective one of the blocks, a current is permitted to flow from the short-circuited cone to the corresponding gate electrode portion which exceeds the first current-carrying capability of the connection.

7. A field emission microcathode array comprising:

a substrate having a main surface;

a plurality of cones formed on the main surface of the substrate and arranged in a respective plurality of blocks, each of said blocks comprising a plurality of respective cones and each of said cones having a sharp tip and emitting an electron beam from the sharp tip thereof when induced by field emission;

a gate electrode comprising a main electrode portion connected to a common power source and a plurality of electrically and structurally independent gate electrode portions respectively corresponding to the plurality of blocks and disposed within the main electrode portion, each of said gate electrode portions being electrically isolated by a surrounding groove from the main electrode portion and from each other said gate electrode portion and having a plurality of openings therein corresponding to the plurality of cones of the respective one of the blocks, each of said openings being aligned with and disposed in surrounding relationship relatively to the corresponding tip of the respectively associated one of the cones; and a plurality of conductor elements of electrically conductive material, comprising corresponding portions of the gate electrode material, independently electrically connecting the respectively corresponding gate electrode portions to the main electrode portion, each of the plurality of conductor elements being configured as a fuse and providing a current conducting path connecting the respective one of the gate electrode portions to the main electrode portion.

8. A field emission microcathode array comprising:

a substrate having a main surface;

a plurality of cones formed on the main surface of the substrate and arranged in a plurality of blocks, each of said blocks comprising a plurality of respective cones and each of said cones having a sharp tip and emitting an electron beam from the sharp tip thereof when induced by field emission;

a gate electrode comprising a plurality of electrically and structurally independent gate electrode portions having respective peripheries and respectively corresponding to the plurality of blocks, each of said gate electrode portions having a plurality of openings therein corresponding to the plurality of cones of the respective one of the blocks and each of said openings being aligned with and disposed in surrounding relationship relatively to the corresponding tip of the respectively associated one of the cones, the gate electrode portions being made of an electrically conducting material; and a wiring portion, comprising an electrically conducting material, disposed around the peripheries of and contacting the gate electrode portions, the wiring portion and the gate electrode portions being made of respective, relatively lower and higher resistance materials.

9. A field emission microcathode array comprising:

a substrate over which a plurality of cones is formed, each of said cones having a corresponding sharp tip;

a gate electrode having a plurality of openings therein, each of said openings surrounding the corresponding tip of a respective cone, the tips of the cones emitting electron beams because of field emission; and the openings formed on a common gate electrode having respective, different sizes relatively to each other and being intermingled.

10. A printer having a head and a photoconductor drum, the head comprising:

a field emission microcathode array comprising:

a substrate having a main surface, a plurality of cones formed on the main surface of the substrate and arranged in a plurality of blocks, each of said blocks comprising a plurality of respective cones and each of said cones having a sharp tip and emitting an electron beam from the sharp tip thereof when induced by field emission, a gate electrode comprising a plurality of electrically and structurally independent gate electrode portions respectively corresponding to the plurality of blocks, each of said gate electrode portions having a plurality of openings therein corresponding to the plurality of cones of the respective one of the blocks and each of said openings being aligned with and disposed in surrounding relationship relatively to the corresponding tip of the respectively associated one of the cones, and a plurality of lead electrodes respectively connected to the plurality of gate electrode portions, each of said lead electrodes being configured as a fuse and providing an independent connection of the respective one of the gate electrode portions to a common power source;

a fluorescent dot array disposed in facing relationship with respect to the field emission microcathode array, the field emission microcathode array emitting electron beams for selectively irradiating the dots of the fluorescent dot array thereby to cause each of the selectively irradiated fluorescent dots to emit light; and the photoconductor drum having a photoconductor layer on which a latent image is formed by the light emitted by each of the irradiated fluorescent dots of the fluorescent dot array.

11. A printer according to claim 10, wherein the gate electrode of the field emission microcathode array further comprises:

a main electrode portion connected to the power source, the plurality of gate electrode portions being disposed within the main electrode portion, and a groove isolating each of the plurality of gate electrode portions from the main electrode portion and from each of the other gate electrode portions; and the plurality of lead electrodes comprises a plurality of conductor elements of electrically conductive material respectively corresponding to the plurality of gate electrode portions, each conductor element of the plurality of conductor elements connecting the respectively corresponding one of the gate electrode portions to the main electrode portion.

12. A printer according to claim 10, wherein the main electrode portion and the plurality of gate electrode portions of the field emission microcathode array are formed on the main surface of the substrate.

13. A printer according to claim 11, wherein the plurality of elements of electrically conductive material of the field emission microcathode array comprise respectively corresponding, integral portions of the gate electrode.

14. A printer according to claim 11, wherein, in the field emission microcathode array, the electrically conductive material of the plurality of elements is a low-melting temperature material relative to the melting temperature of the material of the gate electrode.

15. A printer according to claim 11, wherein, in the field emission microcathode array, the connection provided by each element of electrically conductive material has a first current-carrying capability such that a current conducted thereby in excess of the first current-carrying capability causes the connection to be ruptured and wherein, when a cone is short-circuited to the corresponding gate electrode portion of the respective one of the blocks, a current is permitted to flow from the short-circuited cone to the corresponding gate electrode portion which exceeds the first current-carrying capability of the connection.

16. A printer having a head and a photoconductor drum, the head comprising:

a field emission microcathode array comprising:

a substrate having a main surface, a plurality of cones formed on the main surface of the substrate and arranged in a respective plurality of blocks, each of said blocks comprising a plurality of respective cones and each of said cones having a sharp tip and emitting an electron beam from the sharp tip thereof when induced by field emission, a gate electrode comprising a main electrode portion connected to a common power source and a plurality of electrically and structurally independent gate electrode portions respectively corresponding to the plurality of blocks and disposed within the main electrode portion, each of said gate electrode portions being electrically isolated by a surrounding groove from the main electrode portion and from each other of said gate electrode portions and having a plurality of openings therein corresponding to the plurality of cones of the respective one of the blocks, each of said openings being aligned with and disposed in surrounding relationship relatively to the corresponding tip of the respectively associated one of the cones, and a plurality of conductor elements of electrically conductive material, comprising corresponding portions of the gate electrode material, independently electrically connecting the respectively corresponding gate electrode portions to the main electrode portion, each of the plurality of conductor elements being configured as a fuse and providing a current conducting path connecting the respective one of the gate electrode portions to the main electrode portion;

a fluorescent dot array disposed in facing relationship with respect to the field emission microcathode array, the field emission microcathode array emitting electron beams for selectively irradiating the dots of the fluorescent dot array thereby to cause each of the selectively irradiated fluorescent dots to emit light; and the photoconductor drum having a photoconductor layer on which a latent image is formed by the light emitted by each of the irradiated fluorescent dots of the fluorescent dot array.

17. A printer having a head and a photoconductor drum, the head comprising:

a field emission microcathode array comprising:

a substrate having a main surface, a plurality of cones formed on the main surface of the substrate and arranged in a plurality of blocks, each of said blocks comprising a plurality of respective cones and each of said cones having a sharp tip and emitting an electron beam from the sharp tip thereof when induced by field emission, a gate electrode comprising a plurality of electrically and structurally independent gate electrode portions having respective peripheries and respectively corresponding to the plurality of blocks, each of said gate electrode portions having a plurality of openings therein corresponding to the plurality of cones of the respective one of the blocks and each of said openings being aligned with and disposed in surrounding relationship relatively to the corresponding tip of the respectively associated one of the cones, the gate electrode portions being made of an electrically conducting material, and a wiring portion, comprising an electrically conducting material, disposed around the peripheries of and contacting the gate electrode portions, the wiring portion and the gate electrode portions being made of respective, relatively lower and higher resistance materials;

a fluorescent dot array disposed in facing relationship with respect to the field emission microcathode array, the field emission microcathode array emitting electron beams for selectively irradiating the dots of the fluorescent dot array thereby to cause each of the selectively irradiated fluorescent dots to emit light; and the photoconductor drum having a photoconductor layer on which a latent image is formed by the light emitted by each of the irradiated fluorescent dots of the fluorescent dot array.

18. A printer having a head and a photoconductor drum, the head comprising:

a field emission microcathode array comprising:

a substrate over which a plurality of cones is formed, each of said cones having a corresponding sharp tip, a gate electrode having a plurality of openings therein, each of said openings surrounding the corresponding tip of a respective cone, the tips of the cones emitting electron beams because of field emission, and the openings formed on a common gate electrode having respective, different sizes relatively to each other and being intermingled;

a fluorescent dot array disposed in facing relationship with respect to the field emission microcathode array, the field emission microcathode array emitting electron beams for selectively irradiating the dots of the fluorescent dot array thereby to cause each of the selectively irradiated fluorescent dots to emit light; and the photoconductor drum having a photoconductor layer on which a latent image is formed by the light emitted by each of the irradiated fluorescent dots of the fluorescent dot array.

* * * * *

UNITED STATES PATENT AND TRADEMARK OFFICE

CERTIFICATE OF CORRECTION

PATENT NO. : 5,489,933

DATED : February 6, 1996

INVENTOR(S) : BETSUI et al.

It is certified that error appears in the above-indentified patent and that said Letters Patent is hereby corrected as shown below:

Col. 3, line 65, after "cones and" insert --is--.

Col. 6, line 53, change "electrode 30'" to --electrode 30--.

Col. 9, line 41, change "and a" to --and the--.

Col. 10, line 11, change "respectives," to --respective,--;
line 19, change "respectives," to --respective,--.

Signed and Sealed this

Sixth Day of August, 1996

*Attest:*

Bruce Lehman

BRUCE LEHMAN

*Attesting Officer*

*Commissioner of Patents and Trademarks*